US008087735B1

(12) United States Patent
Rheault et al.

(10) Patent No.: US 8,087,735 B1
(45) Date of Patent: Jan. 3, 2012

(54) FREE STANDING FURNITURE KIT AND METHOD OF ASSEMBLY

(75) Inventors: Alan Rheault, Grand Rapids, MI (US); William Small, Greenville, MI (US)

(73) Assignee: Steelcase Inc., Grand Rapids, MI (US)

( * ) Notice: Subject to any disclaimer, the term of this patent is extended or adjusted under 35 U.S.C. 154(b) by 643 days.

(21) Appl. No.: 12/126,148

(22) Filed: May 23, 2008

Related U.S. Application Data

(60) Provisional application No. 60/941,151, filed on May 31, 2007.

(51) Int. Cl.
*A47B 87/00* (2006.01)

(52) U.S. Cl. ..... 312/109; 312/195; 312/198; 312/351

(58) Field of Classification Search ..... 312/107–109, 312/111, 198–199, 205, 351, 257.1, 195–196
See application file for complete search history.

(56) References Cited

U.S. PATENT DOCUMENTS

| | | | | |
|---|---|---|---|---|
| 1,190,170 | A | 7/1916 | Hormes | |
| 2,489,493 | A | 11/1949 | Kuenzie | |
| 3,015,466 | A | 1/1962 | Levy | |
| 3,305,286 | A * | 2/1967 | Fenwick | 312/263 |
| 3,361,293 | A | 1/1968 | Box | |
| 3,563,624 | A | 2/1971 | Stice | |
| 3,571,987 | A | 3/1971 | Anderson | |
| 3,653,734 | A | 4/1972 | Ungaro | |
| 3,746,417 | A | 7/1973 | Sasnett | |
| 3,874,753 | A * | 4/1975 | Naito et al. | 312/111 |
| 3,892,452 | A | 7/1975 | Williams et al. | |
| 3,971,605 | A | 7/1976 | Sasnett | |
| 4,085,867 | A | 4/1978 | Heller | |
| 4,109,328 | A | 8/1978 | Mason | |
| 4,116,509 | A * | 9/1978 | Smith | 312/107 |
| 4,162,113 | A * | 7/1979 | Pallavicini | 312/199 |
| 4,199,775 | A | 4/1980 | Agraz-Guerena et al. | |
| 4,660,901 | A | 4/1987 | Shimada | |
| 4,717,101 | A | 1/1988 | Harrod | |
| 4,752,106 | A | 6/1988 | Salvarani | |
| 4,753,055 | A | 6/1988 | Durham, Jr. | |
| 4,758,056 | A | 7/1988 | Buck et al. | |
| 4,969,378 | A | 11/1990 | Lu et al. | |
| 4,974,386 | A | 12/1990 | Eriksson et al. | |
| 5,048,698 | A | 9/1991 | Konrad | |
| 5,086,593 | A | 2/1992 | Walentine | |
| 5,163,567 | A | 11/1992 | Betts, Sr. | |
| 5,394,658 | A * | 3/1995 | Schreiner et al. | 52/36.1 |

(Continued)

*Primary Examiner* — Hanh V Tran
(74) *Attorney, Agent, or Firm* — Quarles & Brady LLP

(57) ABSTRACT

A free standing furniture apparatus including a furniture unit having a unit height dimension, a base including a base wall having a base height dimension and first and second separated base wall ends, the base wall at least in part circumscribing a base space where the base wall includes a top edge surface that resides substantially in a single edge plane and a back wall member supported by the base wall proximate the first and second ends of the base wall member and extending substantially vertically upward from the base wall member and substantially perpendicular to the single edge plane so that there is a receiving space that is unobstructed by the back wall member and that is above the base space for receiving the furniture unit, the back wall member having a back wall height dimension that is greater than the unit height dimension so that at least a portion of the back wall member is observable above the furniture unit when the furniture unit is received within the receiving space, wherein the furniture unit is receivable on the top edge surface of the base wall within the receiving space.

24 Claims, 27 Drawing Sheets

U.S. PATENT DOCUMENTS 5,466,085 A 11/1995 Sheldon et al.
5,486,041 A * 1/1996 Sykes ..... 312/111
5,720,547 A 2/1998 Baird
5,754,995 A 5/1998 Behrendt
5,769,514 A * 6/1998 Brown et al. ..... 312/195
5,855,422 A 1/1999 Naef
5,860,839 A 1/1999 Hall
5,884,784 A 3/1999 Betts, Sr.
6,405,941 B2 6/2002 Ganser
6,443,316 B1 9/2002 Mao
6,647,652 B1 11/2003 Seiber et al.
D494,334 S * 8/2004 Chen ..... D34/19
6,830,299 B2 12/2004 Henriott et al.
6,877,824 B2 4/2005 Winkless
6,953,231 B2 * 10/2005 Markofer ..... 312/223.3
7,100,999 B2 9/2006 Stravitz
7,174,678 B2 2/2007 Gallant
7,204,714 B2 4/2007 Walker et al.
2003/0164663 A1 * 9/2003 Chang et al. ..... 312/107
2005/0279033 A1 12/2005 Faber et al.
2007/0013272 A1 * 1/2007 Fells ..... 312/108
2007/0170823 A1 7/2007 Stannis

* cited by examiner

FREE STANDING FURNITURE KIT AND METHOD OF ASSEMBLY

CROSS-REFERENCE TO RELATED APPLICATIONS

This application is related to and claims priority to provisional patent application No. 60/941,151 which was filed on May 31, 2007 and that is titled "Free Standing Furniture Kit And Method Of Assembly".

STATEMENT REGARDING FEDERALLY SPONSORED RESEARCH OR DEVELOPMENT

Not applicable.

BACKGROUND OF THE INVENTION

The present invention relates to free standing wall/furniture assemblies and more specifically to a kit of pre-manufactured furniture and wall parts that can be assembled to configure a large number of different and versatile furniture and wall configurations.

Hospitals and other health care facilities where patient appointments are conducted or that include patient rooms usually have a preference for built in/wall mounted furniture for several reasons. First, it is generally recognized that built in/wall mounted furniture often requires less space than free standing furniture to facilitate the same functions. For example, built in furniture often enables vertical stacking of storage and work surfaces in ways that are not common with free standing furniture. For instance, with built in furniture, storage cabinets are often hung above and spaced from a work surface on a wall so that at least a portion of the space above the work surface can be used for storage thereby alleviating the need for some other space to be used for the same purpose. Because hospitals are always searching for ways to most effectively use space in patient rooms, exam rooms, consultation rooms, physician offices, etc., built in/wall mounted furniture is a natural choice.

Second, built in/wall mounted furniture can be configured in ways that are generally more sanitary than free standing furniture. In this regard, free standing furniture is often arranged or configured so that tight and difficult to access spaces are formed in which liquids and dirt can accumulate and in which germs can prosper. These tight and difficult to access spaces are typically hard to clean. Hard to clean spaces are not acceptable in medical facilities. In contrast, built in/wall hung furniture can be configured so that hard to clean spaces are essentially nonexistent or at least substantially minimized.

Third, built in/wall mounted furniture can, in at least some cases, be less expensive than free standing furniture, because built in furniture often has less finished surface area than free standing furniture. For example, while a free standing desk will often include four completely finished side surfaces, a built in desk includes at most three finished sides and, in some cases, may only include a front finished side.

While built in/wall mounted furniture systems have several advantages that make them particularly suitable for use in medical facilities, known built in/wall mounted furniture systems also have several short comings. First, built in/wall mounted furniture often has to be custom constructed for specific applications and in most cases has to be installed by highly trained carpenters or the like that are skilled at compensating for peculiar characteristics of specific spaces in which the furniture is to be installed. Skilled installers increases the costs associated with built in/wall mounted furniture systems.

Second, built in/wall mounted systems often require mounting or securing of furniture components to permanent space dividing walls for support. Mounting to permanent walls is labor intensive, requires several skills and defaces the walls. In addition, mounting to permanent walls has been known to damage items behind the walls such as power and data cables and, in the case of a medical facility, gas and liquid piping, which can be expensive to repair.

Third, because built in/wall mounted furniture is often customized for specific spaces, it is hard to remove and reuse this type of furniture in other spaces or applications. For these reasons, in many cases, built in/wall mounted furniture is scrapped after a first use and new furniture is used when a new layout is desired. Scrapping components is costly and wasteful.

One solution that has worked well in the office furniture industry for achieving a look and feel similar to built in/wall mounted furniture has been to use free standing wall/furniture systems instead of the built-ins. For example, wall structures akin to partition wall structures have been designed for use against or immediately adjacent permanent walls. Here, bottom storage assemblies (i.e. cabinets, drawer assemblies, etc.) are placed against front faces of the walls, top work surfaces are added to the bottom storage assemblies and top storage assemblies are mounted to top portions of the front faces of the walls. These freestanding wall/furniture systems typically include highly engineered connecting solutions so that system assembly, disassembly and reconfiguration are very easy. In addition, as the label implies, these "freestanding" systems do not require connection to permanent wall structure and therefore do not deface permanent walls or cause any damage to components (i.e., cables, pipes, etc.) there behind.

While freestanding wall/furniture systems work well in offices, known freestanding wall/furniture systems are not suitable for many medical facility environments for several reasons. First, while the connection mechanisms for these assemblies facilitate quick component connection/disconnection, the connection mechanisms often include spaces, slots, openings and other small recesses that are difficult to keep clean and where germs and liquids can accumulate and therefore these systems are relatively unsanitary.

Second, because the connection mechanisms and the components that they connect to are highly engineered for their specific purposes, these components and mechanisms are relatively expensive and therefore increase overall system costs appreciably which renders these systems too expensive for many applications.

Third, while cabinets, drawer assemblies, shelving units, etc., have been modularized, other furniture components used with free standing furniture systems are far more difficult to modularize. For instance, work surfaces have been difficult to modularize. To this end, work surface users typically like a completely flat and single plane surface with very tight seams. Despite highly accurate manufacturing processes that can be used to manufacture storage units that have essentially identical dimensions, when those units are places one next to the other in a patient room or the like, nuances in the supporting floor often result in misaligned or at least extremely difficult to align top surfaces. For this reason it has been standard practice to provide single piece work surface forming top members that span over multiple modular storage units or to provide top surface members that can be pieced together on sight using mechanical fasteners to provide the work surfaces. Where single piece top members have been used, design is constrained by the number of different types of top surfaces supplied (e.g., while several top surfaces may be provided for two or three storage unit configurations, in most cases no single top surface will be provided for ten unit configurations). Where multiple top members are fastened together on sight, assembly costs increase appreciably.

One additional problem with wall surfaces in medical facilities is that the wall structures often are defaced when various devices including dispensers, device and medical item holders, containers, etc., are mounted thereto and then removed so that other dispensers, holders and containers can be mounted in their stead. In the medical industry, replacement of dispensers and other devices and containers is routine as new products come to market and facilities change suppliers routinely. Often new mounting holes have to be drilled in the walls when new dispensers, holders and containers are mounted. Over time the walls where items are mounted begin to look shabby as holes from previously mounted dispensers, devices and containers are exposed.

Thus, it would be advantageous to have a furniture system that can provide the look and feel of built in/wall mounted furniture that is versatile, relatively sanitary, relatively inexpensive and easy to install. In addition, it would be advantageous to have a system that has the aforementioned characteristics where the system components can be relatively easily decoupled and reconfigured. Moreover it would be advantageous to have a mounting structure for dispensers and other items that can be replaced periodically so that old and unused mounting holes are not visible thereon.

BRIEF SUMMARY OF THE INVENTION

It has been recognized that a huge number of different elegant and relatively sanitary furniture assemblies can be designed and assembled relatively inexpensively by providing a kit of wall subassemblies and different types of furniture units where multiple furniture unit types can be included with any one of the wall subassemblies and where the wall subassemblies can be secured together using standard off the shelf connectors. In at least some embodiments the standard connectors include bolts or screws. Here, the seems between adjacent wall subassemblies can be made extremely narrow to substantially eliminate spaces in which debris can collect and in which germs can accumulate.

An exemplary wall subassembly according to at least some inventive embodiments includes a base, a back wall subassembly mounted to and extending up from the base and a canopy mounted at the top end of the back wall subassembly. When securing two wall subassemblies together, in at least some embodiments the back wall subassemblies and the canopies are aligned and secured together while the bases are not. Here, the bases remain uncoupled so that each of the bases can be independently height adjusted and leveled. Furniture units are supported by the bases in receiving spaces and therefore, when the bases are leveled, the top surfaces of the furniture units are also leveled. Thus, where top edge surfaces of the bases on which the furniture units are to be supported are level and coplanar, where the furniture units have identical height dimensions, the tops of the furniture units are also coplanar and should be level. In at least some embodiments each furniture unit includes a work surface forming top member and, when the furniture units are installed, adjacent top members are coplanar and the seem there between is extremely narrow.

The invention also includes, according to another aspect, several methods of assembling furniture configurations using a kit of furniture parts. In general the methods include assembling wall subassemblies at an intermediate or assembly location and securing the wall subassemblies together to form an intermediate wall subassembly, moving the intermediate wall subassembly into a final use position, leveling the bases of each of the wall subassemblies in the intermediate subassembly and then installing furniture units within the wall subassembly receiving spaces.

At least some inventive embodiments include a free standing furniture apparatus comprising a furniture unit having a unit height dimension, a base including a base wall having a base height dimension and first and second separated base wall ends, the base wall at least in part circumscribing a base space where the base wall includes a top edge surface that resides substantially in a single edge plane and a back wall member supported by the base wall proximate the first and second ends of the base wall member and extending substantially vertically upward from the base wall member and substantially perpendicular to the single edge plane so that there is a receiving space that is unobstructed by the back wall member and that is above the base space for receiving the furniture unit, the back wall member having a back wall height dimension that is greater than the unit height dimension so that at least a portion of the back wall member is observable above the furniture unit when the furniture unit is received within the receiving space, wherein the furniture unit is receivable on the top edge surface of the base wall within the receiving space.

In some cases the base wall includes at least first, second and third substantially flat and planar base wall members where the first and second base wall members are parallel and spaced apart and form the first and second ends of the base wall and wherein the third base wall member extends between the ends of the first and second base wall members opposite the first and second ends of the base wall and it substantially perpendicular to each of the first and second base wall members.

In some cases the back wall member includes a substantially rectangular and planar member that includes oppositely facing front and rear surfaces where the front surface faces the receiving space. Some embodiments further includes a substantially flat planar rear base member that traverses the distance between the first and second ends of the base wall and that is substantially perpendicular to the first and second base wall members. In some cases the base wall member is mounted to the rear base member. In some cases the back wall member includes top and bottom edges and first and second lateral edges and the assembly further includes first and second connectors mounted to the rear surface of the back wall member adjacent the first and second lateral edges for connecting the apparatus to a similar apparatus. In some cases each of the first and second connector members includes an elongated planar rectangular member that extends from the rear surface of the back wall member and substantially along the entire height dimension of the back wall member so that the back wall member and the first and second connector members together form a channel adjacent the rear surface of the back wall member. In some embodiments the first and second connector members are mounted to the top edges of the first and second base wall members proximate the first and second ends of the base wall, respectively.

In some cases the assembly is for use with a similar second furniture apparatus wherein the assembly further includes fasteners for securing the first connector member to a similar connector member on the second furniture apparatus.

In some cases the base wall includes an internal surface that defines the base space and the furniture unit includes at least one cleat extending from the bottom thereof that is adjacent at least a portion of the internal surface of the base wall when the furniture unit is supported on the top edge of the base wall.

In some embodiments the back wall member include a top end opposite the base, the assembly further including a canopy supported at the top end of the back wall member that extends above the receiving space and that is spaced above the furniture unit when the unit is received in the receiving space. In some cases the canopy includes a canopy wall having a canopy height dimension and first and second separated canopy wall ends, the canopy wall at least in part circumscribing a canopy space where the canopy wall includes a bottom edge surface that resides substantially in a single bottom edge plane, the first and second ends of the canopy wall mounted to top ends of the first and second connector members, respectively.

In some cases the back wall height dimension is between sixty and 96 inches. In some cases the furniture unit height is between fifteen and 44 inches.

At least one other embodiment includes a free standing furniture apparatus for use with a furniture unit, the apparatus comprising a base including a base wall having a base height dimension and first and second separated base wall ends, the base wall at least in part circumscribing a base space where the base wall includes a top edge surface that resides substantially in a single edge plane, a back wall member supported by the base wall proximate the first and second ends of the base wall member and extending substantially vertically upward from the base wall member and substantially perpendicular to the single edge plane so that there is a receiving space that is unobstructed by the back wall member above the base space for receiving the furniture unit, the back wall member having a back wall height dimension of at least sixty inches and having top and bottom ends along top and bottom edges, respectively; and a canopy supported at the top end of the back wall member that extends above the receiving space.

In some cases the back wall member includes first and second lateral edges and oppositely facing front and rear edges and wherein the assembly further includes first and second connectors mounted to the rear surface of the back wall member adjacent the first and second lateral edges for connecting the apparatus to a similar apparatus. In some cases each of the first and second connector members includes an elongated planar rectangular member that extends from the rear surface of the back wall member and substantially along the entire height dimension of the back wall member so that the back wall member and the first and second connector members together form a channel adjacent the rear surface of the back wall member. In some cases the canopy includes a canopy wall having a canopy height dimension and first and second separated canopy wall ends, the canopy wall at least in part circumscribing a canopy space where the canopy wall includes a bottom edge surface that resides substantially in a single bottom edge plane, the first and second ends of the canopy wall mounted to top ends of the first and second connector members, respectively. In some cases the canopy height dimension is between two inches and ten inches and wherein the base height dimension is between two and ten inches.

Other embodiments include a free standing furniture apparatus for use with a furniture unit, the apparatus comprising a base wall including first, second and third substantially flat and planar base wall members and a rear base wall member wherein the third base wall member and the rear base wall member are substantially parallel and spaced apart and wherein the first and second base wall members are parallel, spaced apart and traverse the distance between ends of the third base wall and the rear base wall so as to form a rectangle that defines a base space, the base wall having a base height dimension and having a top edge that resides substantially in a single edge plane, a substantially rectangular back wall member supported by the base wall substantially above the rear base wall member and extending substantially vertically upward from the base wall member and substantially perpendicular to the single edge plane so that there is a receiving space that is unobstructed by the back wall member above the base space for receiving the furniture unit, the back wall member having top and bottom edges, first and second side edges, oppositely facing front and rear surfaces and top and bottom ends adjacent the top and bottom edges, respectively, first and second elongated, substantially flat and planar connector members mounted to and extending from the rear surface of the back wall member adjacent and along substantially the entire length of the first and second side edges of the back wall member, respectively, a canopy supported at the top end of the back wall member that extends above the receiving space, the canopy including a canopy wall including first, second and third substantially flat and planar canopy wall members wherein the first and second canopy wall members are mounted at first ends to the first and second connector members, are parallel and are spaced apart and the third canopy wall member is connected between the first and second canopy wall members at the ends of the first and second canopy wall members opposite the connector members so that the canopy wall members together circumscribe a canopy space substantially above the receiving space, the canopy wall including a bottom edge surface that resides substantially in a single bottom edge plane, the canopy further including a planar flat soffit member supported by the canopy wall adjacent the bottom edge plane.

Still other embodiments include a free standing furniture apparatus comprising a furniture unit having a unit height dimension and a rear side, a substantially rectangular back wall member having top, bottom and first and second lateral edges, oppositely facing front and rear surfaces, top and bottom ends adjacent the top and bottom edges, respectively, and a back wall height dimension between the top and bottom edges that is greater than the unit height dimension, the back wall member secured to the rear side of the furniture unit and extending substantially vertically upward from the furniture unit, first and second elongated, planar and substantially rectangular connector members mounted to and extending from the rear surface of the back wall member adjacent the first and second lateral edges, respectively, where each connector member extends substantially along the entire height dimension of the back wall member so that the back wall member and the first and second connector members together form a channel adjacent the rear surface of the back wall member and a canopy supported at the top end of the base wall member, the canopy extending above and spaced above the furniture unit.

Yet other embodiments include a method for configuring a free standing furniture assembly for use in a final position, the method comprising the steps of providing at least first and second furniture subassemblies at an assembly location, each of the first and second subassemblies including at least a base, a back wall member and a furniture unit, the base including a base wall and first and second separated base wall ends, the base wall at least in part circumscribing a base space where the base wall includes a top edge surface that resides substantially in a single edge plane, the back wall member supported by the base wall proximate the first and second ends of the base wall member, extending substantially vertically upward from the base wall member and substantially perpendicular to the single edge plane and forming a front surface, positioning the first furniture subassembly next to the second furniture subassembly in an intermediate position that is different than the final position so that the front surface of the back wall member of the first furniture subassembly is flush with the front surface of the back wall member of the second furniture subassembly and so that at least a portion of the base wall of the first furniture subassembly is adjacent at least a portion of the base wall of the second furniture subassembly, securing the back wall members of the first and second furniture subassemblies together to form an intermediate wall assembly, moving the intermediate wall assembly into the final position, leveling the base walls of the first and second furniture subassemblies so that the edge planes thereof are substantially horizontal, placing the furniture unit of the first furniture subassembly on the top edge surface of the base wall of the first furniture unit assembly and placing the furniture unit of the second furniture subassembly on the top edge surface of the base wall of the second furniture unit assembly.

Other embodiments include a furniture apparatus comprising a first furniture subassembly forming a first storage space, a substantially straight first upper track supporting surface and a substantially straight first lower track supporting surface below the first upper track supporting surface, a second furniture subassembly forming a second storage space, a substantially straight second upper track supporting surface and a substantially straight second lower track supporting surface below the second upper track supporting surface, the second furniture subassembly positioned adjacent the first furniture subassembly so that the second upper track supporting surface is aligned with the first upper track supporting surface, the second lower track supporting surface is aligned with the first lower track supporting surface and the second storage space is adjacent the first storage space, a lower track mounted to and extending along the first and second lower track supporting surfaces, an upper track mounted to and extending along the first and second upper track supporting surfaces and a door member mounted between the lower track and the upper track for movement there along between various positions adjacent the first and second storage spaces.

Still other embodiments include a furniture apparatus comprising a first furniture subassembly including a first base, a first canopy and a first intermediate structure that supports the first canopy above the first base wherein the area between the first base and the first canopy forms a first storage space, the first canopy forming a substantially straight first upper track supporting surface adjacent a front side of the first canopy, a second furniture subassembly including a second base, a second canopy and a second intermediate structure that supports the second canopy above the second base wherein the area between the second base and the second canopy forms a second storage space, the second canopy forming a substantially straight second upper track supporting surface adjacent a front side of the second canopy, the second furniture subassembly positioned adjacent the first furniture subassembly so that the second base is adjacent the first base, the second canopy is adjacent the first canopy, the second upper track supporting surface is aligned with the first upper track supporting surface and the second storage space is adjacent the first storage space, a lower track supported by the first and second bases below the first and second upper track supporting surfaces, an upper track mounted to and extending along the first and second upper track supporting surfaces and a door member mounted between the lower track and the upper track for movement there along between various positions adjacent the first and second storage spaces.

Other embodiments include a kit of parts for configuring a multitude of freestanding furniture configurations, the kit including at least a first wall subassembly including a base wall and a back wall member, the base wall having a base height dimension and first and second separated base wall ends, the base wall at least in part circumscribing a base space where the base wall includes a top edge surface that resides substantially in a single edge plane, the back wall member forming a front surface and supported by the base wall proximate the first and second ends of the base wall member and extending substantially vertically upward from the base wall member to a top end and substantially perpendicular to the single edge plane so that a receiving space above the base space and adjacent the front surface of the back wall member is unobstructed by the back wall member and a first subset of furniture units wherein each of the furniture units in the first subset is a different furniture unit type, each of the furniture units in the first subset configured to be received within the receiving space and to be supported on the top edge surface of the base wall adjacent the front surface of the back wall member, wherein, each of the furniture units in the first subset can be supported on the top surface of the base wall within the receiving space to configure a different furniture configuration.

Other embodiments include a kit of parts for configuring a multitude of freestanding furniture configurations, the kit including a plurality of first wall subassemblies, each of the first wall subassemblies including a base wall and a back wall member, each base wall having a base height dimension and first and second separated base wall ends, each base wall at least in part circumscribing a base space where the base wall includes a top edge surface that resides substantially in a single edge plane, each back wall member forming a front surface and supported by an associated base wall proximate the first and second ends of the base wall and extending substantially vertically upward from the base wall and substantially perpendicular to the single edge plane so that a receiving space above the base space and adjacent the front surface of the back wall member is unobstructed by the back wall member and a first subset of furniture units including several different furniture unit types, each of the furniture units in the first subset configured to be received within any one of the receiving spaces and to be supported on the top edge surface of one of the base walls adjacent one of the front surfaces of one of the back wall members, wherein two or more of the first wall subassemblies can be secured together with the front surfaces of the wall subassemblies substantially coplanar and wherein a separate furniture unit from the first subset can be supported on the top surface of each of the base walls within the receiving spaces to configure a furniture configuration.

Other embodiments include an assembly for mounting accessories to a front wall surface of a wall member, the assembly comprising a planar board member including substantially oppositely facing and flat front and rear surfaces, at least a first quick release fastener for releasably securing the board member to the front wall surface so that the front surface of the board member is accessible for mounting accessories, wherein the fastener facilitates release of the board member from the wall front surface so that the board member can be disposed of and replaced by a new board member after the front surface of the board member is defaced.

Some embodiments further include at least one accessory mounted to the front surface of the board member. Some embodiments further including a plurality of accessories mounted to the front surface of the board member via screws that pass into the front surface of the board member. In some cases accessories can be mounted to any location on the front surface of the board member. In some cases the board member is between one quarter and one inch thick.

Still one other embodiment includes a method for supporting accessories on a front wall surface of a wall member, the method comprising the steps of providing a first rigid planar board member including substantially oppositely facing and flat front and rear surfaces, mounting a first coupler to the front wall surface, securing the first board member to the front wall surface via the first coupler so that the rear surface of the board member is adjacent the front wall surface, forming mounting holes in the front surface of the first board member for mounting at least a first accessory and mounting at least the first accessory to the front surface of the first board member via the mounting holes.

Other embodiments include a free standing furniture apparatus comprising a base including a base wall and first and second separated base wall ends, the base wall at least in part circumscribing a base space where the base wall includes a top edge surface that resides substantially in a single edge plane, a receiving space above the base space, a canopy supported by the base above the receiving space and including a downwardly facing bottom edge surface and a furniture unit including a bottom member that has a front edge and that forms an exposed upwardly facing surface along at least a portion of the front edge, the furniture unit received in the receiving space so that the exposed upwardly facing surface resides below the downwardly facing bottom edge surface of the canopy.

One other inventive method for configuring a free standing furniture assembly for use in a final position includes the steps of providing a furniture unit, providing a first back wall member, providing a first base including a base wall and first and second separated base wall ends, the base wall at least in part circumscribing a base space where the base wall includes a top edge surface that resides substantially in a first edge plane and where a receiving space for receiving a furniture unit is located above the base space, securing the back wall member to the base wall at an intermediate assembly location to form an intermediate wall assembly, moving the intermediate wall assembly into a final position, leveling the base wall of the first base so that the first edge plane is substantially horizontal and placing the furniture unit on the top edge surface of the base wall.

To the accomplishment of the foregoing and related ends, the invention, then, comprises the features hereinafter fully described. The following description and the annexed drawings set forth in detail certain illustrative aspects of the invention. However, these aspects are indicative of but a few of the various ways in which the principles of the invention can be employed. Other aspects, advantages and novel features of the invention will become apparent from the following detailed description of the invention when considered in conjunction with the drawings.

DETAILED DESCRIPTION OF THE INVENTION

Figure 1:
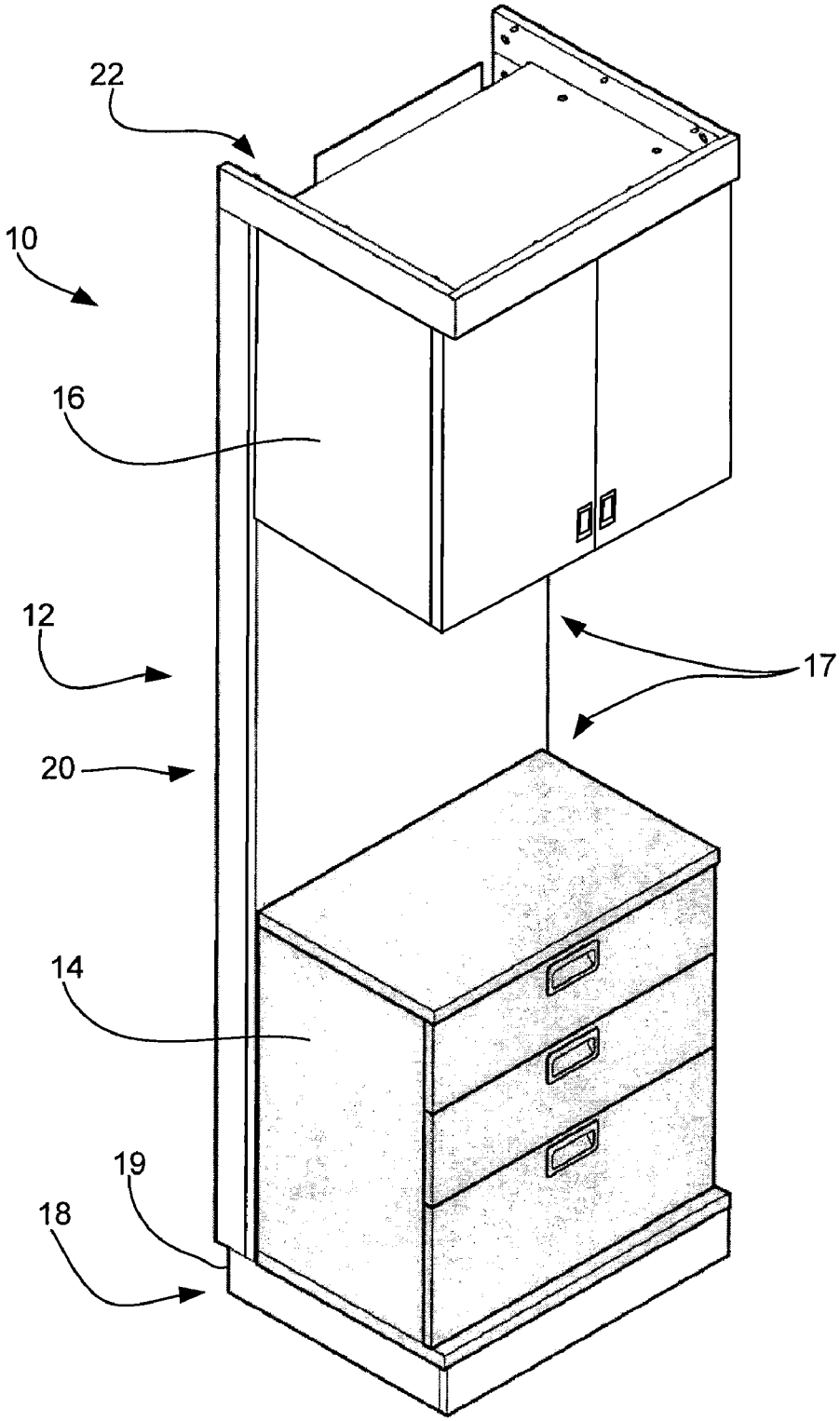
FIG. 1 is a perspective view of an exemplary furniture assembly consistent with at least some aspects of the present invention.

Referring now to the drawings wherein like referenced numerals correspond to similar elements throughout the several views and, more specifically, referring to FIGS. 1 through 14, at least some aspects of the present invention will be described in a context of an exemplary free standing furniture assembly 10 including, among other components, a first wall subassembly 12, a lower furniture unit in the form of a drawer assembly 14 and an upper furniture unit in the form of a cabinet 16. As shown, wall subassembly 12 includes a base 18, a back wall subassembly 20 and a canopy 22 that together define a storage space 17 (see FIGS. 1 and 2 specifically) for receiving the upper and lower furniture units 16 and 14, respectively.

Figure 2:
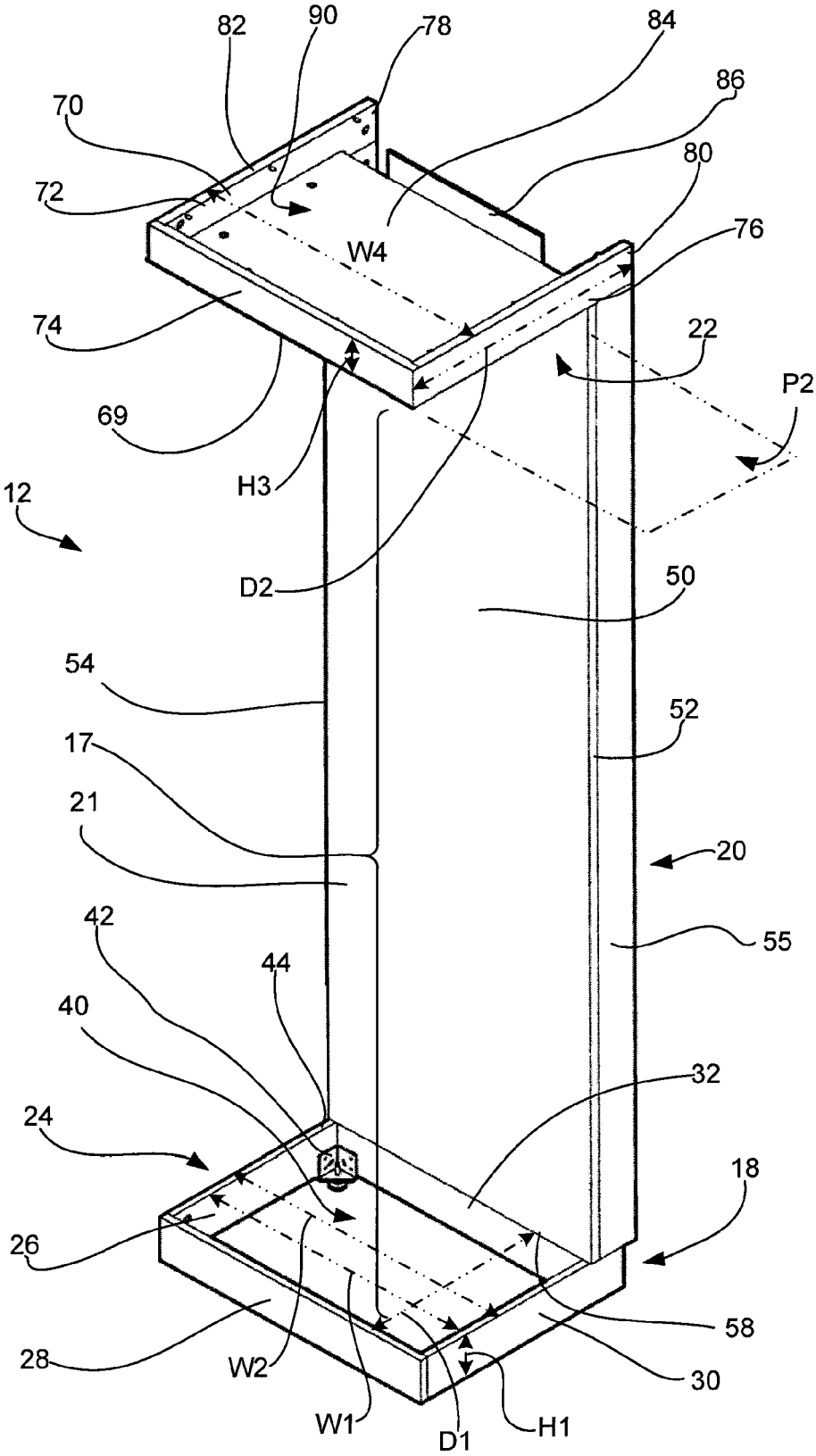
FIG. 2 is a perspective view of the wall subassembly of FIG. 1.
Figure 3:
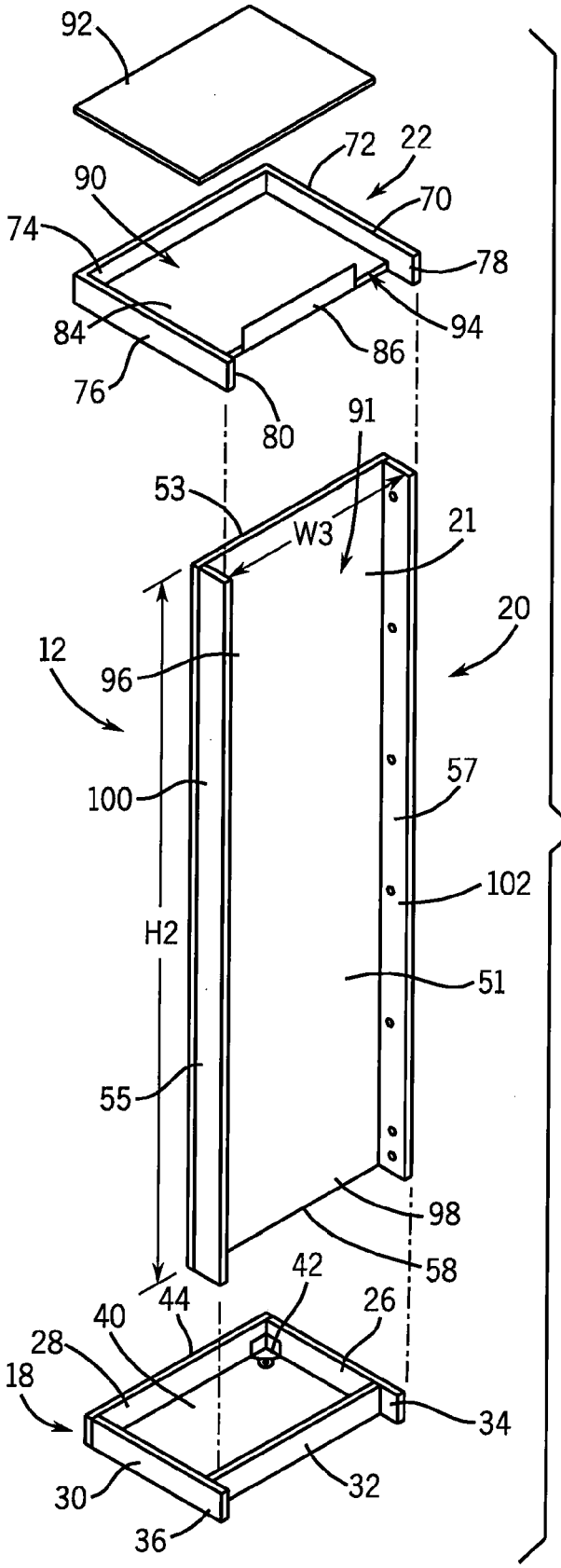
FIG. 3 is an exploded rear perspective view of the subassembly of FIG. 2.

Referring specifically to FIGS. 2 and 3, base 18 includes a base wall 24 that has a base height dimension H1 (e.g., between 2 and 10 inches) and first and second separated base wall ends 34 and 36, respectively. The base wall 24 circumscribes a base space 40 where the base wall 24 includes a top edge surface 44 that resides substantially in a single edge plane P1 (see also FIG. 13). In the illustrated embodiment, the base wall 24 forms a rectilinear base space 40 and, to that end, includes a first base wall member 26, a second base wall member 30, a third base wall member 28 and, in at least some embodiments, a rear base wall member 32.

Third base wall member 28 is an elongated, planar, rectangular and substantially flat wall member having first and second ends and forms a front kick or toe board. Hereinafter, third base wall member 28 is referred to as a toe board. The first and second base wall members 26 and 30 extend from opposite ends of toe board 28 in the same direction and perpendicular to toe board 28 and terminate at the first and second base wall ends 34 and 36, respectively, as best shown in FIG. 3. Rear base wall member 32 traverses the distance between the first and second base wall members 26 and 30 and is substantially parallel to toe board 28. As shown best in FIG. 3, rear base wall member 32 is spaced apart from the edges of first and second base wall ends 34 and 36, respectively, so that the ends 34 and 36 jut rearward of member 32. For example, rear base wall member 32 may be spaced from the rear edges of first and second base wall members 26 and 30 by between 1 and 5 inches. Hereafter, the portions of wall members 26 and 30 that extend rearward of member 32 will be referred to as base wall extensions 34 and 36.

Figure 8:
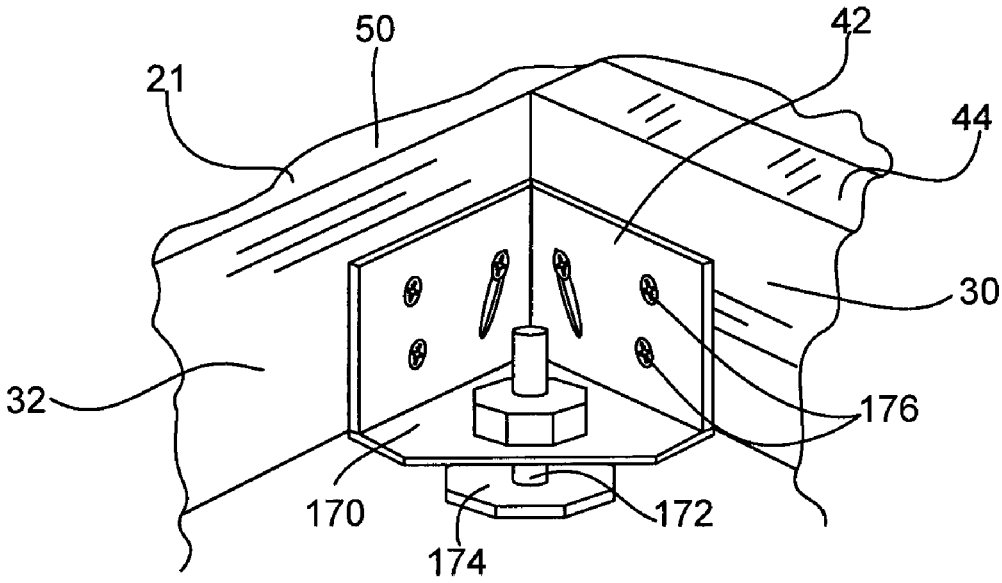
FIG. 8 is an enlarged perspective view showing the exemplary height adjustment glide of FIG. 2 in greater detail.

Referring still to FIGS. 2 and 3 and now also FIG. 8, in at least some embodiments, several height adjustable glide assemblies or glides 42 are provided that are mounted to the base 18 and that are usable to adjust the height of to edge surface 44 that forms the top edge of base 18. Although only 2 height adjustment glides 42 are shown in FIGS. 2 and 3, it should be appreciated that, in at least some embodiments, four separate glides 42 will be provided for each base 18, a separate one of the glides 42 mounted to each inside corner of the rectilinear base wall structure. Exemplary glide 42 shown in FIG. 8 includes a bracket 170, a threaded adjustment knob 172 and foot member 174. Bracket 170 mounts to a corner of base 18 formed by an inside surface of two adjacent wall members (e.g., 26 and 32). To this end, bracket 170 forms a plurality of screw holes (not labeled) through which screws (two screws identified by numeral 176) can pass to mount bracket 170 to base 18. Bracket 170 also forms a generally vertically oriented threaded opening for receiving threaded adjustment shaft 172. Foot member 174 is secured to the lower end of shaft 172. The supported height of base 18 can be adjusted by rotating shaft 172 with respect to bracket 170 to increase or decrease the distance between foot member 174 and an undersurface of bracket 170.

Referring again to FIG. 2, base 18 has specific relative dimensions when compared to furniture units to be used therewith. To this end, the facing surfaces of first and second base wall members 26 and 30 form a width dimension W1, while the outside surfaces of first and second base wall members 26 and 30 form a width dimension W2 which is greater than dimension W1. In addition, the inside surface of rear base wall member 32 and the outside surface of toe board 28 form a depth dimension D1.

Referring again to FIGS. 1 through 3, back wall subassembly 20 includes a back wall member 21 and first and second connector members 57 and 55, respectively. Exemplary back wall member 21 is a substantially flat, rigid, rectilinear and a planer member having oppositely facing front and rear surfaces 50 and 51, respectively, top and bottom straight edges 53 and 58, respectively, first and second side or lateral edges 54 and 52, respectively, and top and bottom ends or portions 96 and 98 adjacent top and bottom edges 53 and 58, respectively. Back wall member 21 has a height dimension H2 (e.g., 60 to 96 inches) and a width dimension W3. Width dimension W3 may be anywhere from 12 to 48 inches and in advantageous embodiments is 24 or 36 inches. Here, width dimension W3 is slightly greater than width dimension W2 (see again FIG. 2) formed by the outer surfaces of base wall members 26 and 30.

First and second connector members 57 and 55, respectively, have similar constructions and operate in a similar fashion and therefore, in the interest of simplifying this explanation, only second connection member 55 will be described here in detail. Connector member 55, as shown, is an elongated, rigid, flat and substantially planer rectilinear member that has a height dimension (not labeled) similar to height dimension H2 of back wall member 21 and a substantially reduced width dimension (not labeled) (e.g., within a range of 1 to 7 inches). Second connector member 55 forms an external surface 100 and an oppositely facing internal surface (not labeled, however, an exemplary internal surface 102 of first connector member 57 is shown in FIG. 3). Second connector member 55 is secured to the rear surface 51 of back wall member 21 and extends the entire height H2 of back wall member 21 immediately adjacent second side edge 52. Similarly, first connector member 57 is mounted to rear surface 51 and extends along the entire length of second side edge 54. Thus, the rear surface 51 of back wall member 21 and the internal surfaces (e.g., 102 in FIG. 3) of connector members 55 and 57 forms a channel 91.

Figure 13:
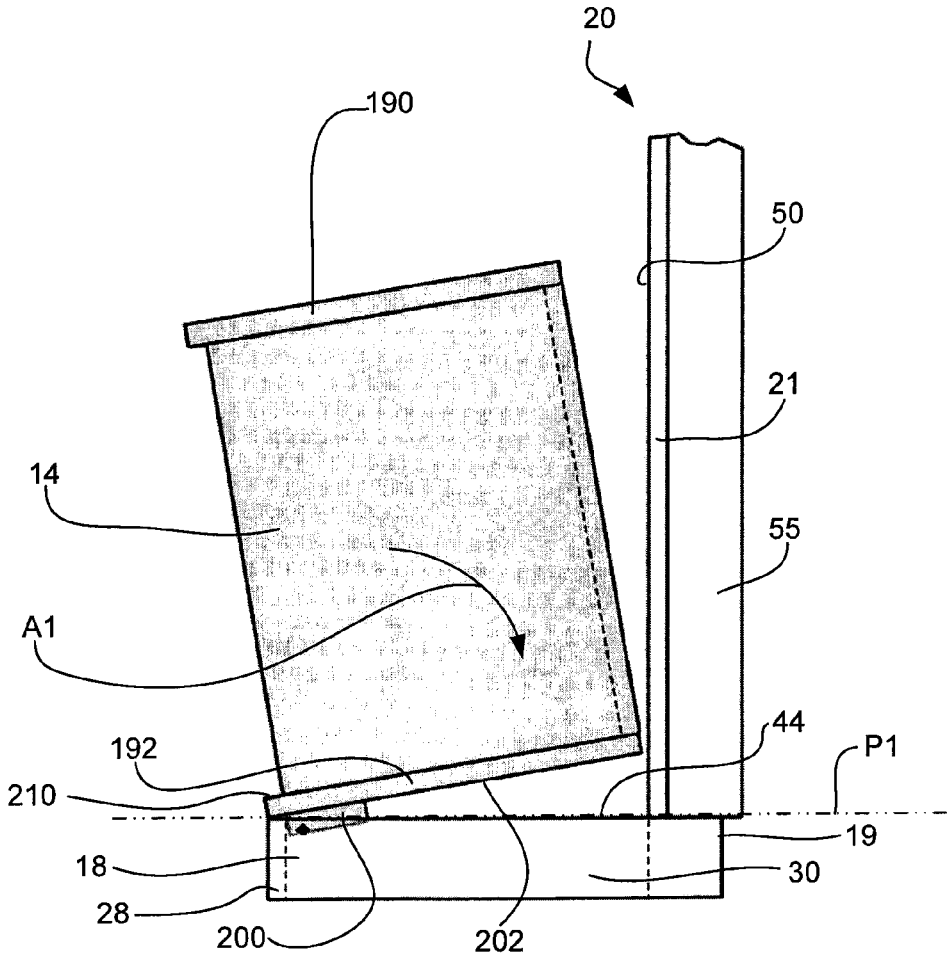
FIG. 13 is a side view showing the drawer unit of FIG. 9 in an intermediate installation position.

Although not illustrated, connector member 55 has a depth dimension that is greater than the extend to which base wall extensions 34 and 36 extend from rear base wall member 32. For instance, where extensions 34 and 36 extend from rear wall member 32 four inches, connector member 55 may have a depth dimension of four and ½ to five inches. As seen in FIG. 13, upon assembly, the differences in dimension between members 34 and 36 and the depth dimension of member 55 results in recessed corners 19 to accommodate base board molding and/or power and data cables where needed.

Figure 32:
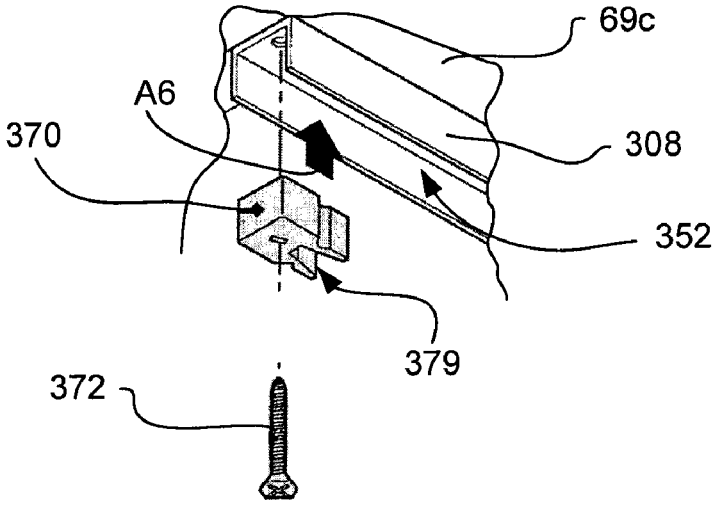
FIG. 32 is an enlarged perspective view showing an end stop member being installed at the end of the top track of FIG. 23.

Referring yet again to FIGS. 1 through 3, exemplary canopy 22 includes a canopy wall 70 that has first and second separated canopy wall ends 78 and 80 where the canopy wall circumscribes a canopy space 90 and the canopy wall includes a bottom edge surface 69 (see also, 69*c* and 69*d* in FIGS. 25 and 32) that resides in a single bottom edged plane. In the illustrated embodiment, canopy wall 70 includes a first canopy wall member 72, a second canopy wall member 76 and a third canopy wall member 74 where member 74 extends between first and second ends along a front edge of canopy space 90 and members 72 and 76 extend in the same direction from the first and second ends of member 74 back to the first and second ends 78 and 80 of the canopy wall 70.

Referring specifically to FIG. 2, canopy 22 has a height dimension H3 (e.g., two to ten inches) between the top and bottom surfaces of wall 70, a width dimension W4 between the external surfaces of the first and second canopy wall member 72 and 76 and a depth dimension D2 between the external surface of third canopy wall member 74 and the second end 80 of wall member 76. In the illustrated embodiment, width dimension W4 is identical to width W3 of back wall member 21 (see also FIG. 3) and depth dimension D2 is greater than the depth dimension D1 between the front or external surface of toe board 28 and the internal surface of rear base member 32 by a dimension equal to the thickness of back wall member 21 and the depth (not labeled) of connector member 55 so that, when the front surface 50 of rear wall member 21 is flush with the interior surface of rear base wall member 32, the external or front surface of canopy wall member 74 resides in substantially the same plane as the front or external surface of base wall member 28.

Referring still to FIGS. 1 through 3, in addition to canopy wall 70, in the illustrated embodiment, canopy 22 includes a planer, flat, rectilinear and rigid soffit member 84 that is mechanically mounted in any fashion between the internal surfaces of canopy wall members 72, 74 and 76. In at least some embodiments, soffit member 84 may be transparent or translucent so that, if an illumination device is placed within canopy space 90, light generated thereby can, at least in part, pass there through and into the space there below. While not illustrated, in other embodiments, speakers, wireless access points or other useful devices may be placed within the canopy space 90. As shown, soffit member 84 does not extend all the way back to the first and second ends 78 and 80 of canopy wall 70 and instead a space is provided between ends 78 and 80 and the rear edge of soffit member 84. This space between the rear edge of member 84 and ends 78 and 80 is provided to accommodate power and/or data cables needed to drive devices within canopy space 90.

Figure 7:
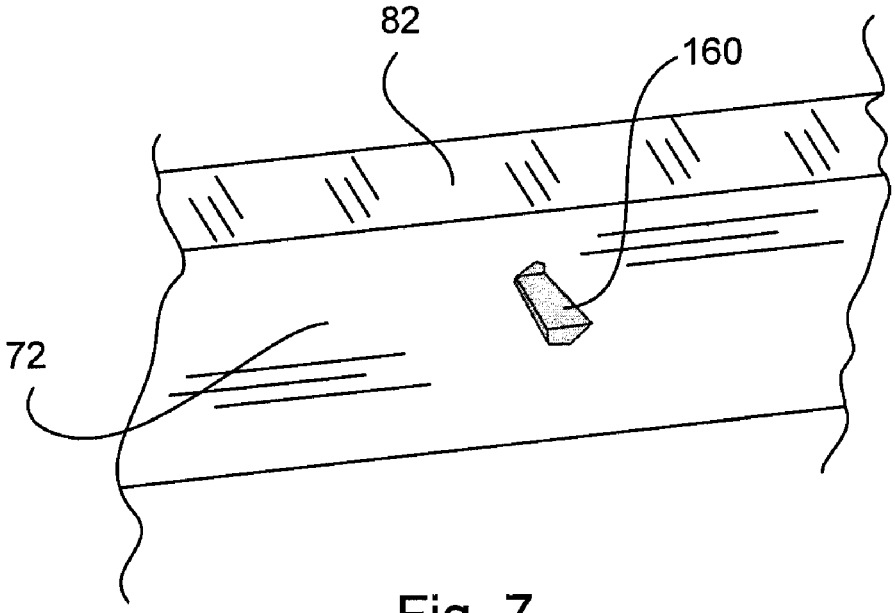
FIG. 7 is an enlarged view showing a dust cover supporting peg that may be included in some embodiments of the present invention.

Referring now to FIG. 3, in at least some embodiments, because electronic, lighting and other devices may be provided within canopy space 90 and, generally, to reduce the number of spaces in which grime can accumulate, a dust cover 92 may be provided that is supported by canopy structure above the canopy space 90. An exemplary dust cover 92 is shown in FIG. 3. To support dust cover 92 above space 90, a dust cover support member 86 extends upward from a rear edge of soffit member 84. Support 86 is shorter than the width (not labeled) of dust cover 84 and is centered along the rear edge thereof so that openings 94 are provided on either side of support 86 to accommodate power and/or data cables and, also, to enable airflow into and out of canopy space 90 when devices therein generate heat. Referring also to FIG. 7, in addition to including support 86 for dust cover 92, a plurality of pegs 160 may be mounted (i.e., frictionally received within holes) to the internal surfaces of canopy wall members 72, 74 and 76 where the pegs 160 are generally co-planer with the top edge of support 86. Here, the dust cover 92 can simply be placed on top of the pegs 160 and the top edge of support 86 to substantially conceal space 90.

Referring once again to FIGS. 1 through 3, to assemble subassembly 12, back wall subassembly 20 is secured to the top surface 44 of base 18 with front surface 50 of rear wall member 21 substantially coplanar with the internal surface of rear base wall member 32 and the external surfaces (see 100 in FIG. 3) of connector members 55 and 57 slightly outboard of the external surfaces of base wall members 30 and 26, respectively. The first and second ends 78 and 80 of canopy wall 70 are secured to the top ends of connector members 57 and 55, respectively, with rear edges of ends 78 and 80 substantially flush with the rear edges of connector members 57 and 55, respectively, so that canopy 22 is mounted to the top end 96 of back wall subassembly 20. Once canopy 22 is mounted to back wall subassembly 20, external surfaces of members 76 and 82 are flush with external surfaces (e.g., 100) of connector members 55 and 57, respectively.

Figure 4:
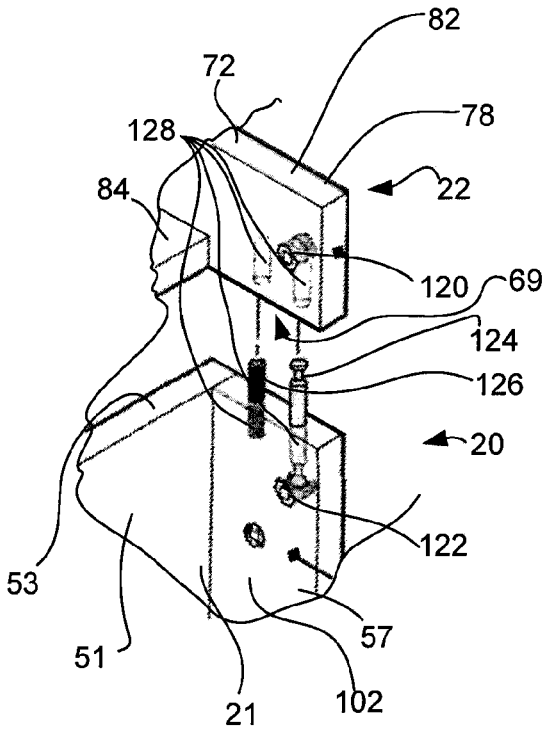
FIG. 4 is an enlarged partially exploded view of a portion of FIG. 3 showing connection features for connecting the canopy of FIG. 3 to the back wall subassembly of FIG. 3.

Referring also to FIG. 4, to secure canopy 22 to back wall subassembly 20, a plurality of holes collectively identified by numeral 128 are formed in the top ends of connector members 55 and 57 and in the lower edge surface 69 of each of the first and second canopy wall members 72 and 76 adjacent the first and second ends 78 and 80, respectively, of the canopy wall. In FIG. 4, only end 78 and the top end of connector member 57 are shown and it should be appreciated that similar fastening devices are used at end 80 and the top end of connector member 55 (see also FIG. 3). Here, two holes are provided in each of end 78 and member 57 including one hole in each of those members to accommodate a wood dowel 126 and another hole in each of those members to accommodate a pin 124 that cooperates with two quarter turn locking fasteners 120 and 122 as well known in the art to secure end 78 to connector member 57.

In a particularly advantageous embodiment, dowel 126 includes an adhesive that is activated when dowel 126 is wet. Here, dowel 126 is first wetted and is then forced into the opening formed by connector member 57. Next, pin 124 is placed into the opening associated therewith in member 57 and quarter turn locking fastener 122 is turned to lock pin 124 to member 57. Although not illustrated, the dowel and pin to be used to secure connector member 55 to end 80 are similarly installed in the top end of connector member 55 (see again FIG. 3).

Next, with quarter turn fastener 120 installed in end 78 and a similar fastener installed in end 80 (see again FIG. 3), canopy 22 is positioned with ends 78 and 80 above members 57 and 55, respectively, and so that the openings formed in the lower edge surfaces (e.g., 69) of end 78 and 80 are aligned with the dowels and pins there below and canopy 22 is lowered until the dowels and pins are received in the openings formed in ends 78 and 80. Quarter turn fasteners 120 are then turned to mechanically secure canopy 22 to back wall subassembly 20.

Figure 5:
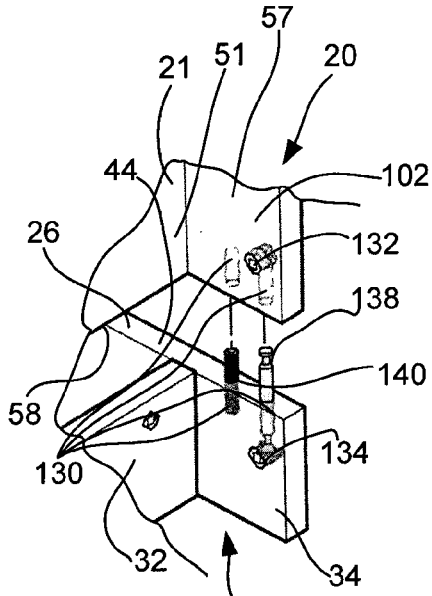
FIG. 5 is an enlarged partially exploded view showing connection features for connecting the back wall subassembly of FIG. 3 to the base of FIG. 3.

Referring again to FIGS. 2 and 3 and now also to FIG. 5, to secure back wall subassembly 22 to base 18, dowel and pin openings are formed in the bottom ends of connector members 57 and 55 and in the top edge surface 44 of the base wall proximate ends 34 and 36. Exemplary dowel and pin openings are collectively labeled 130 in FIG. 5. In addition, in FIG. 5, an exemplary dowel 140, exemplary pin 138 and exemplary quarter turn fasteners 132 and 134 are illustrated.

Figure 6:
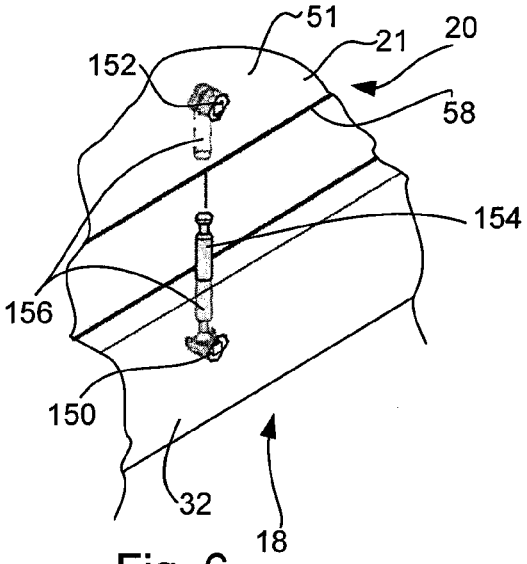
FIG. 6 is an enlarged partially exploded view of additional connection features for connecting the back wall subassembly to the base of FIG. 3.

Referring also to FIG. 6, to provide additional rigidity to the connection between back wall subassembly 20 and base 18, additional openings 156 are provided in a top edge surface of rear base wall 32 and along the bottom edge 58 of back wall member 21 that align when connector members 55 and 57 are aligned with ends 36 and 34. Here, a dual ended pin 154 and two quarter turn fasteners 150 and 152 are provided for each pair of openings 156 to further secure back wall member 21 to rear base wall 32. Referring once again to FIG. 2, at this point, subassembly 12 has been completely constructed. Once configured, the overall height of wall subassembly 12 should be between 72 and 100 inches and, in a particularly advantageous embodiment, will be approximately 84 inches (depending on the degree to which the glides are extended.

In some embodiments only the front or external faces of toe board 28 and canopy wall member 74 are finished along with surface 50 of rear wall member 21. This reduced finish embodiment is typically suitable where an assembly 10 (see again FIG. 1) is to be used in an orientation in which the side surfaces of assembly 10 members will not be viewable after installation. In other embodiments external surfaces of each of members 26, 28, 30,72,74, 76, 55 and 57 are all finished along with front surface 50 and side edges of members 74, 82, 21 where those surfaces may be exposed. In this case, irrespective of whether or not the external surfaces are exposed, a finished furniture appearance results.

Figure 14:
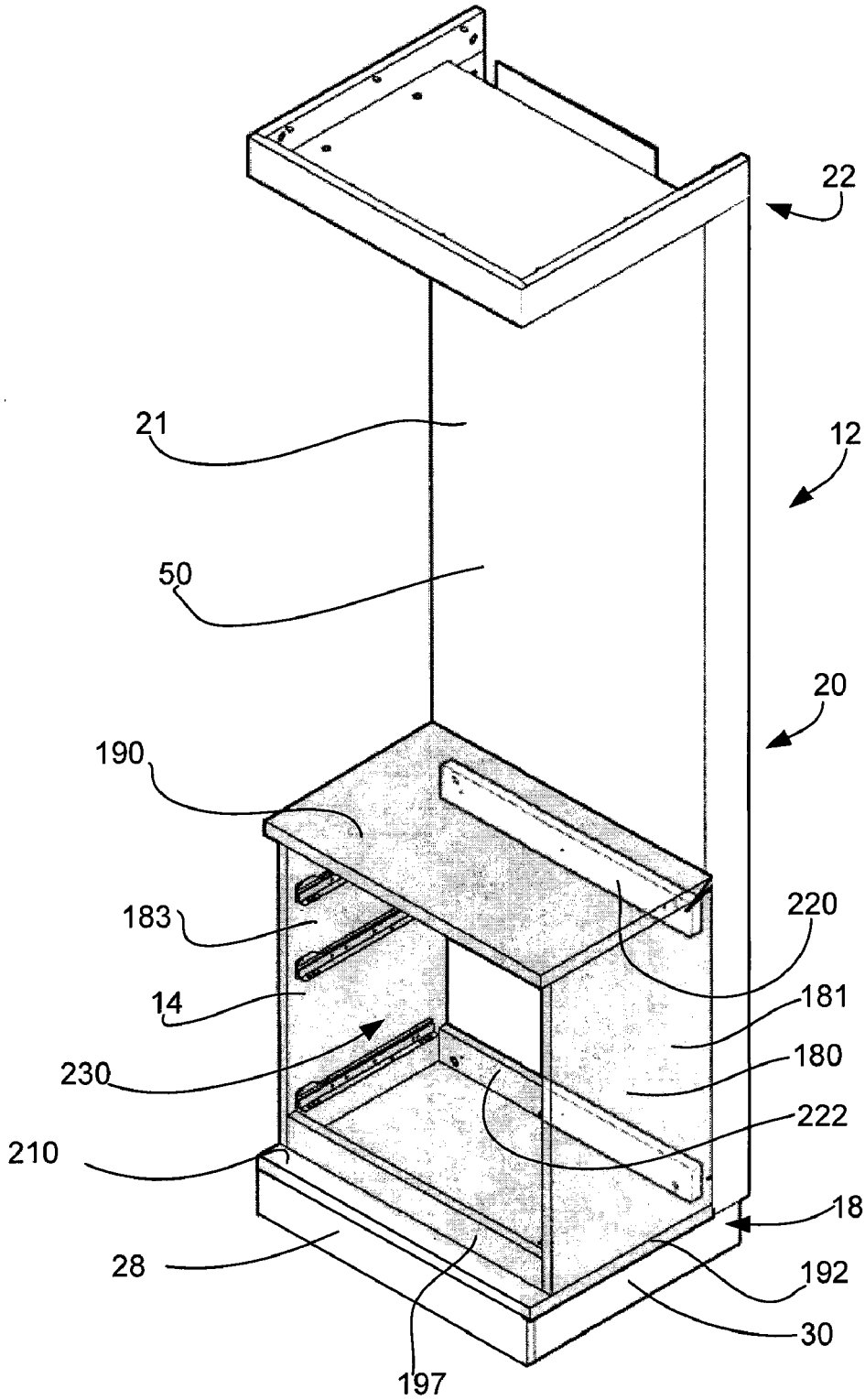
FIG. 14 is a perspective view showing the drawer unit of FIG. 9 in an installed position, albeit with the drawers removed.

Referring now to FIGS. 9 through 12, exemplary furniture unit 14, as indicated above, is a drawer assembly that includes, among other components, a drawer assembly housing 180 and three drawers 182, 184 and 186. Referring also to FIG. 14, housing 180 includes first and second side walls 181 and 183, a unit top member 190, a unit bottom member 192, a front stringer 197 and top and bottom back stringers 220 and 222, respectively. Side walls 181 and 183 are spaced apart, parallel and, in normal use, will be generally vertically oriented. Side wall members 181 and 183 extend up from opposite edges of rectilinear bottom member 192 and unit top member 190 is mounted to the top ends of side wall members 181 and 183 so that, together, members 181, 183, 190 and 192 form a unit space 230 for receiving drawers 182, 184 and 186. Top back stringer 220 extends between side wall members 181 and 183 just below unit top member 190 and adjacent rear edges of sidewalls 181 and 183. Similarly, bottom back stringer 222 is secured to and traverses the distance between side wall members 181 and 183 just above bottom member 192 and adjacent rear edges of side walls 181 and 183. Back stringers 220 and 222 increase the structural integrity of unit 14 and are used to secure unit 14 to front surface 50 of back wall member 21 as will be described in greater detail below. Front stringer 197 is secured between and traverses the distance between side walls 181 and 183 and runs along a top surface of bottom member 192.

Referring once again to FIGS. 9 through 11, furniture unit 14 has a width dimension W5 and a height dimension H4 (e.g., 15 to 44 inches). Bottom member 192 has a depth dimension D3 while the other portions of unit 14 have a reduced depth dimension D4 such that a portion 210 of the top surface of bottom member 192 is exposed upwardly adjacent front stringer 197. The difference between depths D3 and D4 is sufficient to accommodate the thickness of face boards (see 119 in FIG. 9) of the drawers (e.g., 186) and track 310 (see FIG. 30) as described in more detail below.

Figure 10:
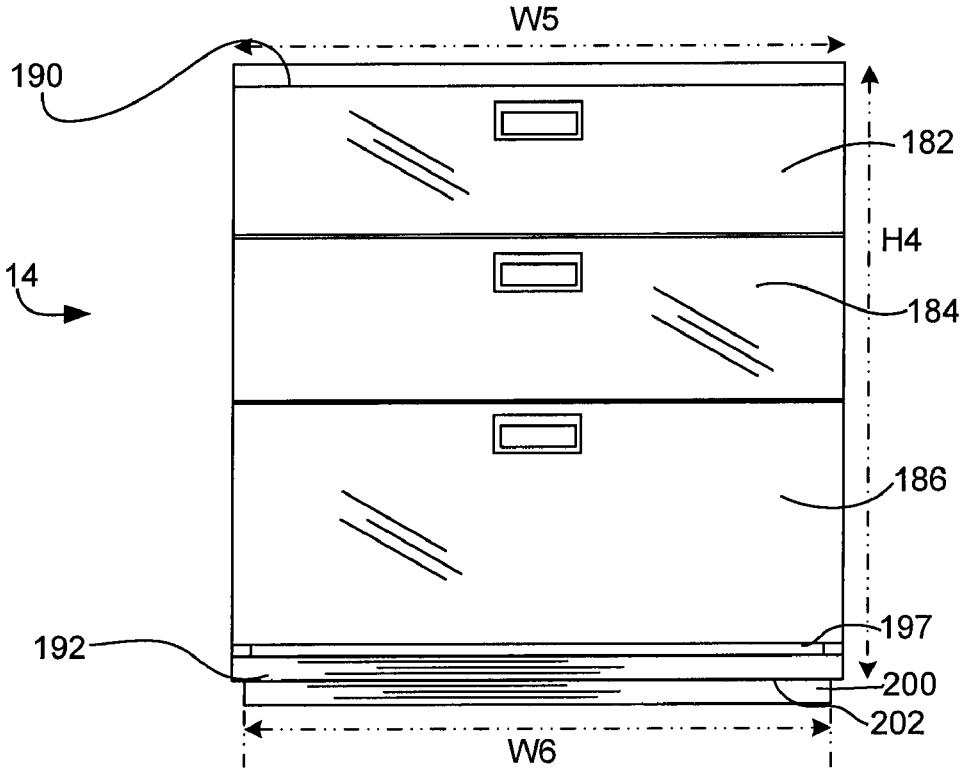
FIG. 10 is a front plan view of the drawer unit of FIG. 9.
Figure 11:
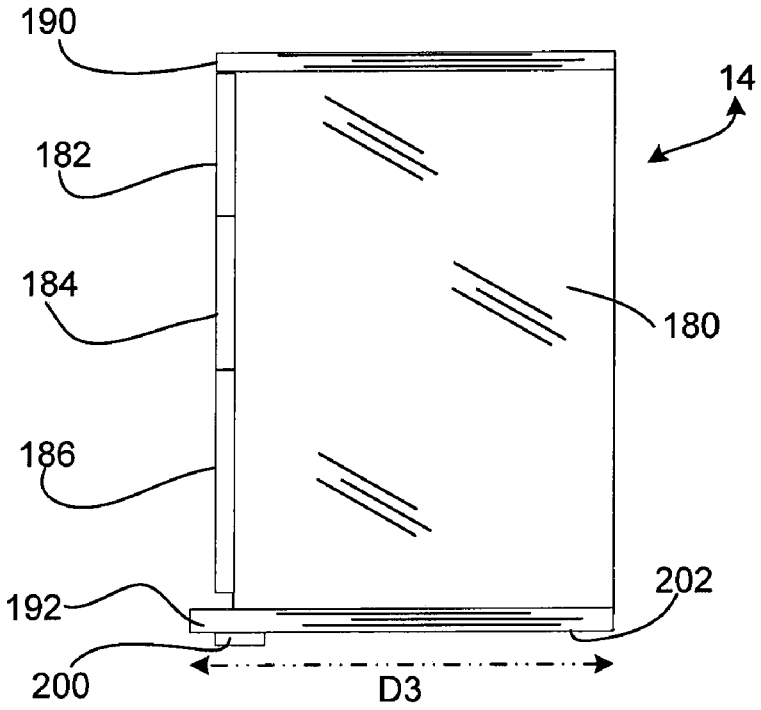
FIG. 11 is a side plan view of the drawer unit of FIG. 9.
Figure 12:
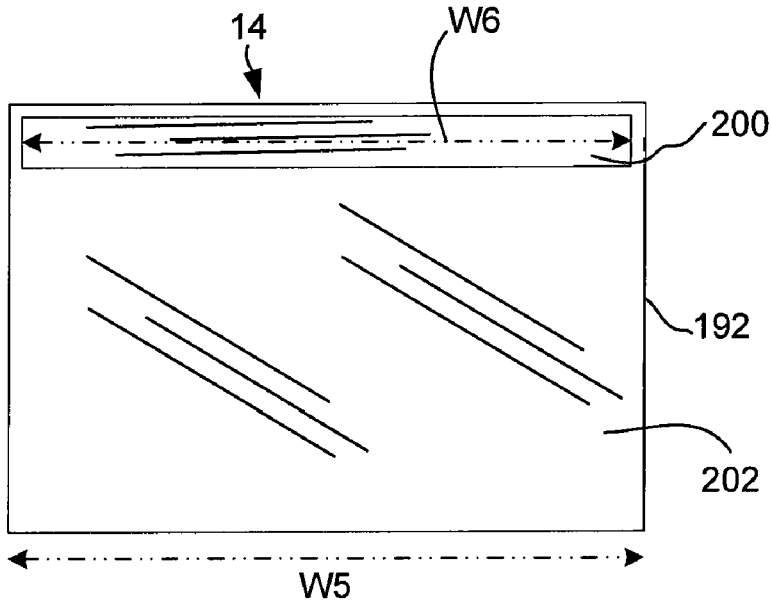
FIG. 12 is a bottom view of the drawer unit of FIG. 9.

Referring still to FIGS. 10 through 12, an elongated rigid cleat 200 is mounted to a bottom surface 202 of bottom member 192 where the cleat has a width dimension W6 that is slightly less than to the width dimension W1 (see also FIG. 2) formed between the first and second base wall members 26 and 30. Cleat 200 is provided to help a system installer align unit 14 with a base 18 in which the unit is to be received as shown in FIG. 13.

Prior to installing unit 14 in space 17, an installer uses glides 42 to level top edge surface 44. Here, base 18 should be leveled while forced downward as unit 14 will force base 18 downward after installation.

Figure 9:
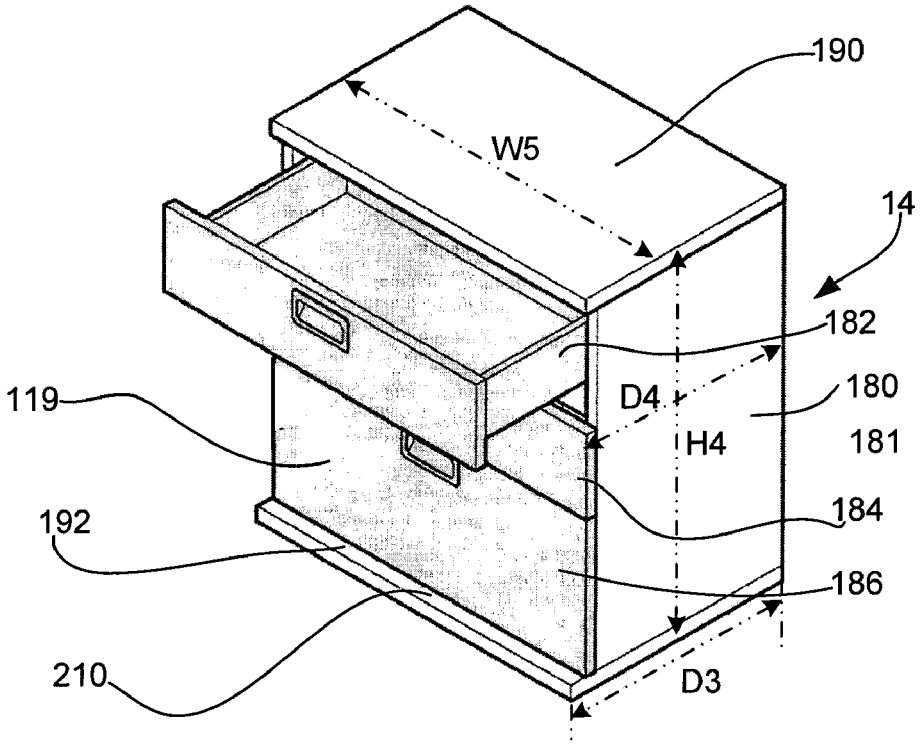
FIG. 9 is a perspective view of the drawer furniture unit shown in FIG. 1, albeit with one of the drawers in an open position.

To install furniture unit 14 in receiving space 17 above the base space 40 shown in FIG. 2, referring also to FIG. 9, drawers 182, 184 and 186 are first removed. Next, a system installer lifts unit 14 and places the front edge of bottom member 192 on the top surface 44 of base wall member 28 as shown in FIG. 13 with cleat 200 received adjacent member 28 within base space 40. The installer then lowers the rear end of unit 14 as indicated by arrow A1 in FIG. 13 until bottom member 192 rests completely on top surface 44 as shown in FIG. 14. Continuing, although not illustrated, screws are used to attach the top and bottom back stringers 220 and 222 to the front surface 50 of back wall member 21. To complete installation, the drawers 182, 184 and 186 are installed within space 230.

Although not shown in detail, it should be appreciated that top storage assembly 16 shown in FIG. 1 is a simple cabinet assembly and would be mounted to front surface 50 via screws and assembly 16 stringers. Here, canopy 22 does not provide structural support for assembly 16.

Figure 15:
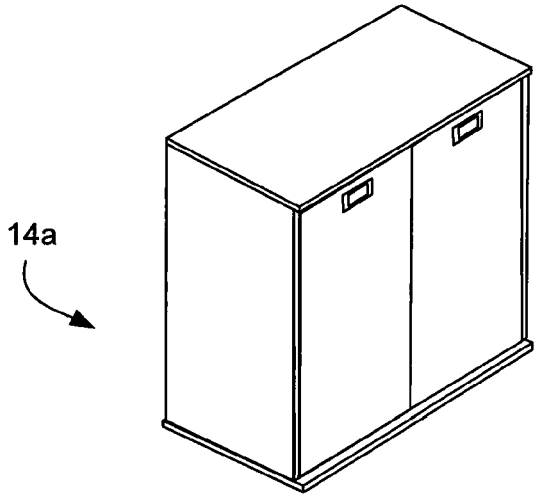
FIG. 15 is a perspective view of a cabinet furniture unit that may be substituted for the drawer unit shown in FIG. 1.
Figure 16:
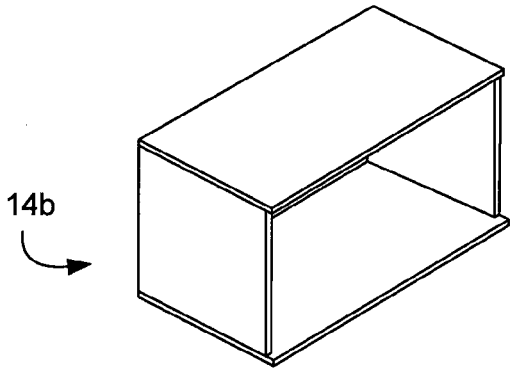
FIG. 16 is a perspective view of a bench furniture unit that may be substituted for the drawer unit shown in FIG. 1.
Figure 17:
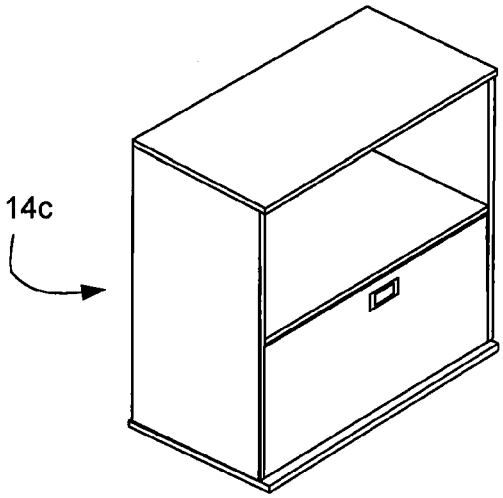
FIG. 17 is a perspective view of a shelf/drawer unit that may be substituted for the drawer unit shown in FIG. 1.

Referring now to FIGS. 15 through 17, three additional exemplary furniture units 14*a*, 14*b*, and 14*c* are shown. Furniture unit 14*a* includes a two door cabinet assembly that has many features that are similar to or identical to the features described above with respect to drawer assembly 14. In this regard, although not illustrated, it is contemplated that the dimensions of cabinet assembly 14*a* would be nearly identical to the dimensions of unit 14, that cabinet assembly 14*a* would include a cleat (not shown) and would also include top and bottom back stringers akin to the stringers 220 and 222 shown in FIG. 14 for securing unit 14*a* to the front surface 50 of back wall member 21. In addition, a bottom member of unit 14*a* forms an upwardly exposed surface akin to surface 210 shown in FIG. 13 for supporting an optional track.

In FIG. 16, a bench unit 14*b* is shown. Here, while unit 14*b* would include back stringers like stringers 220 and 222 shown in FIG. 14, instead of driving screws through the stringers and into back wall member 21 to secure the unit 14*b* to back wall member 21, in some embodiments, it is contemplated that screws may be driven in the opposite direction through back wall member 21 and into the stringers so that, while the stringers could be observed when looking into the open space defined by bench unit 14*b*, the screw heads would be hidden.

FIG. 17 illustrates a shelf/drawer unit 14*c* that has characteristics in common with each of unit 14 and unit 14*b*. Once again, here, unit 14*c* would include back stringers for connecting to a back wall member 21.

Figure 18:
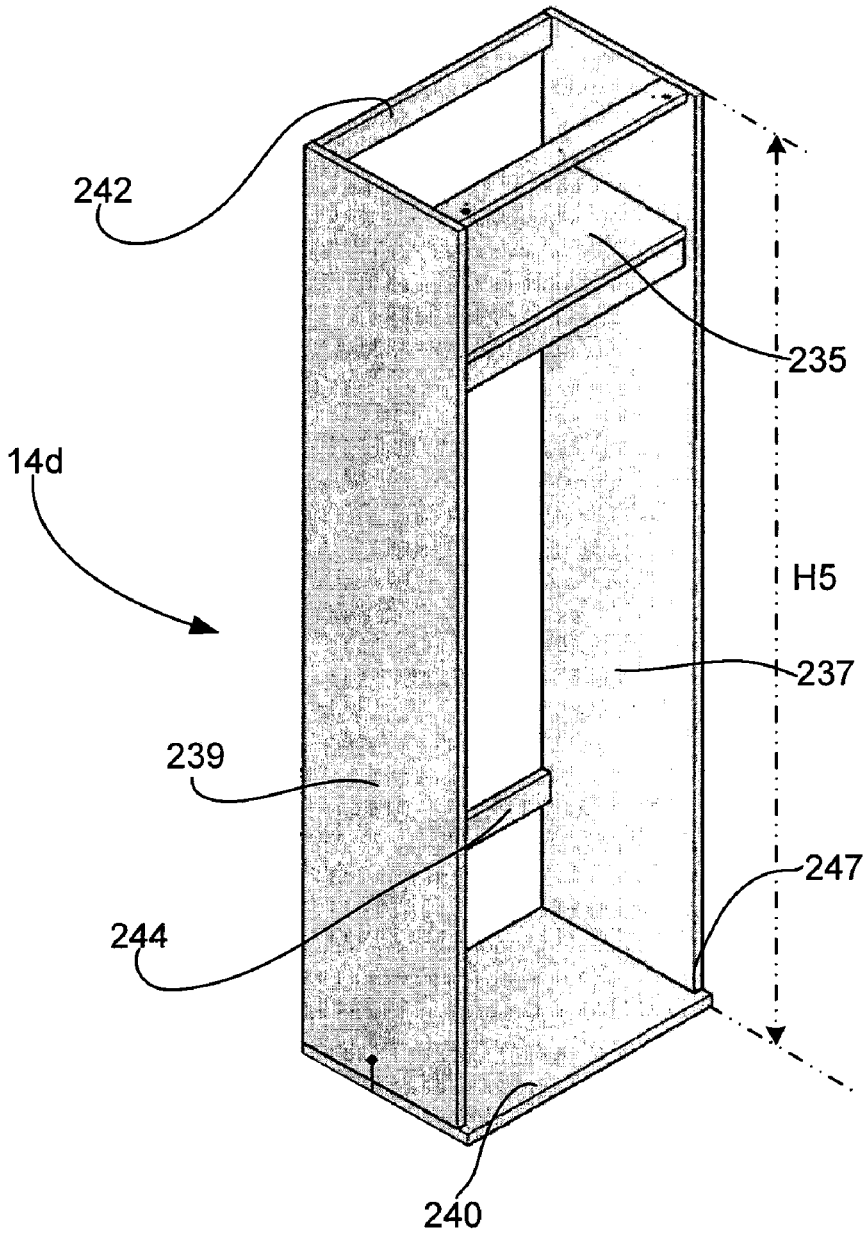
FIG. 18 is a perspective view of a closet unit that may be substituted for the drawer unit shown in FIG. 1.
Figure 30:
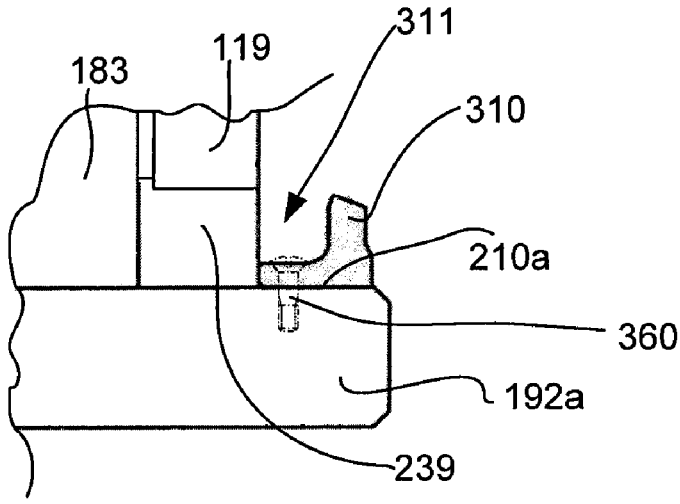
FIG. 30 is an end view of the bottom track shown in FIG. 23.
Figure 31:
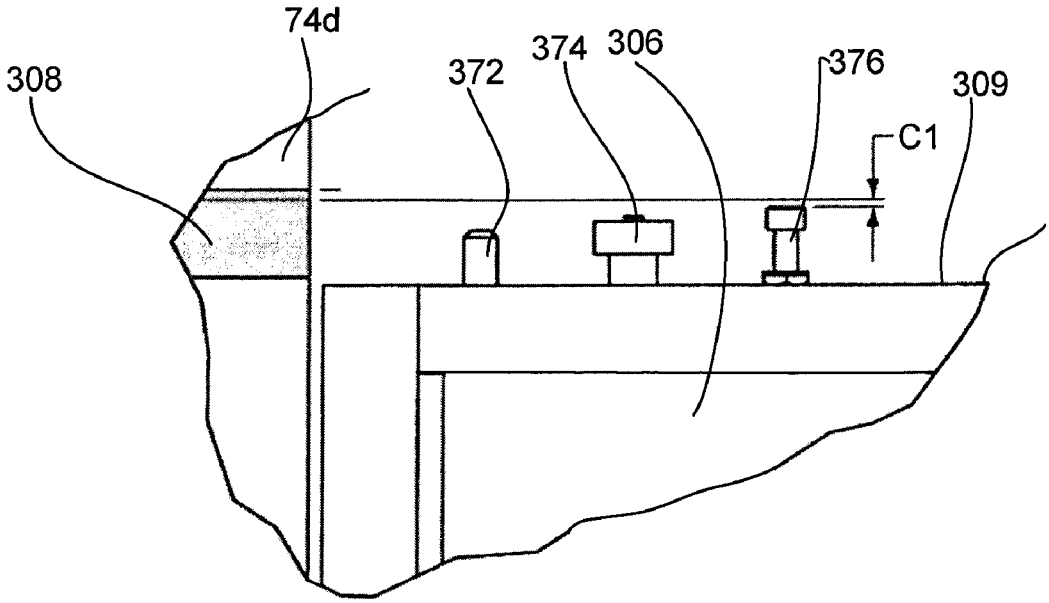
FIG. 31 is an enlarged front plan view showing sliding door structure in an exemplary embodiment.

Referring now to FIG. 18, yet another furniture unit 14*d* is shown, in this case, a closet unit including first and second side wall members 237 and 239, bottom member 240 that is akin to member 192 described above, a shelf 235 and top and bottom stringers 242 and 244, respectively. Here, the height dimension H5 of unit 14*d* is slightly smaller than the height dimension H2 (see again FIG. 3) of exemplary back wall subassembly 20 so that when unit 14*d* is placed within the receiving space 17 (see again FIG. 2) between canopy 22 and base 18, unit 14*d* substantially fills the entire space between top edge surface 44 of base 18 and bottom edge surface 69 of canopy 22. Once again screws may be inserted through stringers 242 and 244 into the back wall member 21 or, in the alternative, can be driven through back wall 21 into the rear surfaces of stringers 242 and 244 where it is desired to hide screw heads. As in the case of unit 14 described above, in this case, bottom member 240 extends past the front edges of side wall members 237 and 239 so that an upwardly exposed lip or surface 247 exists in front of the front edges of walls 237 and 239. Here, because drawer front face boards are not included with unit 14*d*, the dimension between the front edges of the side members 239 and 237 and the front edge of bottom member 240 can be selected to accommodate track 310 only (i.e., as shown in FIG. 30) and the front edge of member 239 can be substantially flush with the front surfaces of the drawer face members 119 when the drawers are inserted in unit 14 and are in a closed position. FIG. 31 described in greater detail below shows exemplary unit 14*d* being slid into a wall assembly space 17.

While the embodiments described above include the first wall subassembly shown in FIG. 2 that, among other components, includes base 18, at least a second wall subassembly for use with furniture units that do not require a base is contemplated for applications where a base or toe board are undesirable. For example, in the case of a furniture unit that comprises a built-in desk or credenza, a toe board or base is not desirable because such a structure would get in the way of a person attempting to use the desk or credenza. To this end, another exemplary furniture apparatus or assembly is shown in FIG. 19 that includes a baseless second wall subassembly 252 and a desk type furniture unit 254.

Figure 19:
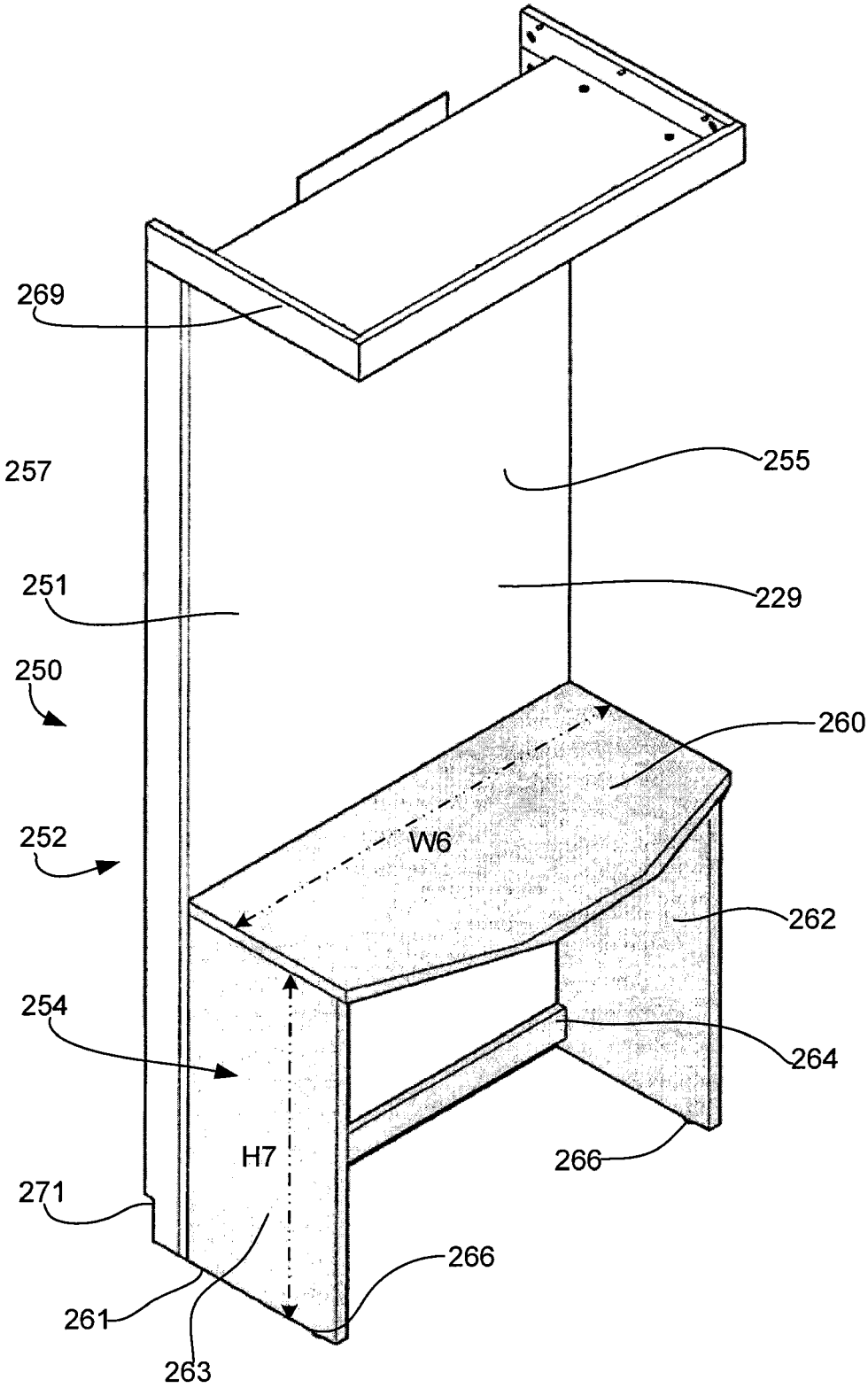
FIG. 19 is a perspective view of a furniture assembly that is consistent with other aspects of the present invention.
Figure 20:
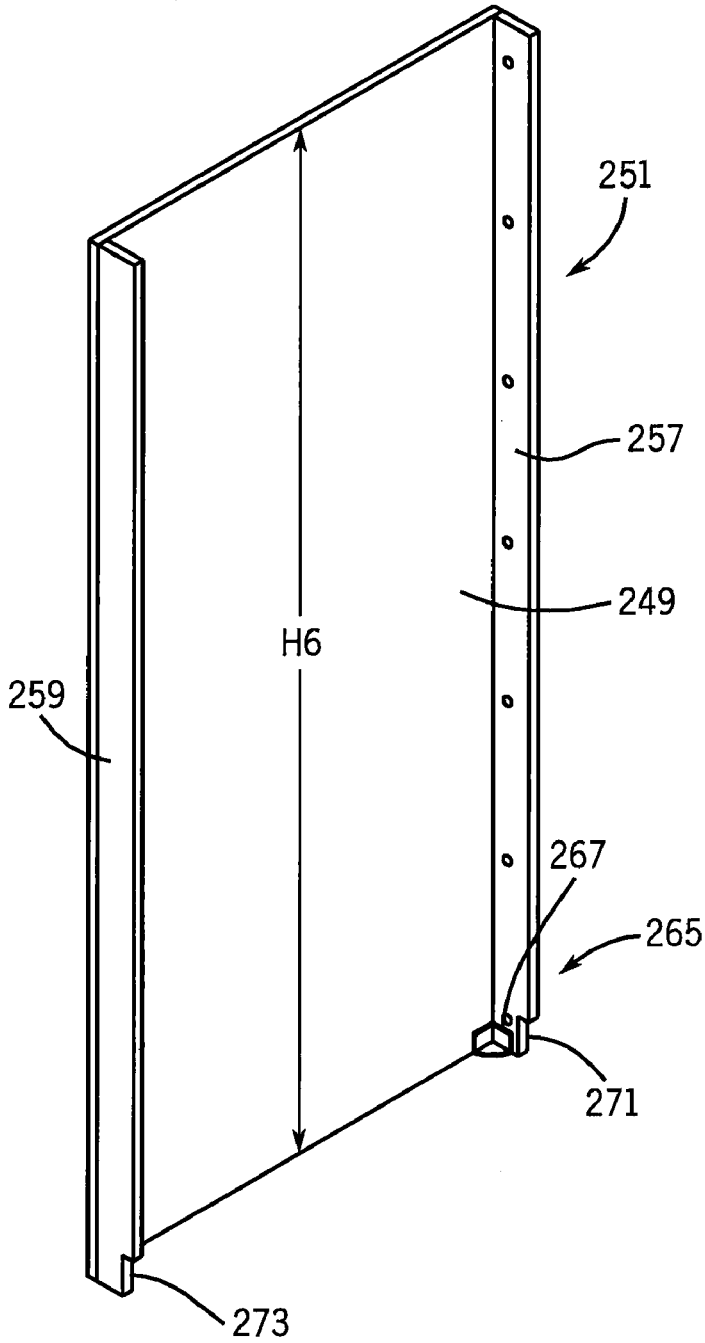
FIG. 20 is a rear perspective view of the back wall subassembly of FIG. 19.

Referring still to FIG. 19 and also to FIG. 20, it should be appreciated that second wall subassembly 252 includes several components and features that are similar to or identical to those described above with respect to the first wall subassembly 12 and therefore, in the interest of simplifying this explanation, those similar or identical features or components will not again be described here in detail. Here, it should suffice to say that subassembly 252 includes a back wall subassembly 251 and a canopy 269. The canopy 269 is substantially similar to the canopy 22 described above with respect to FIGS. 1-3 in that canopy 269 connects to back wall subassembly 251 in a fashion similar to that described above with respect to FIGS. 1-3 and therefore, canopy 269 and the way canopy 269 connects to back wall subassembly 251 will not again be described here in detail.

Figure 21:
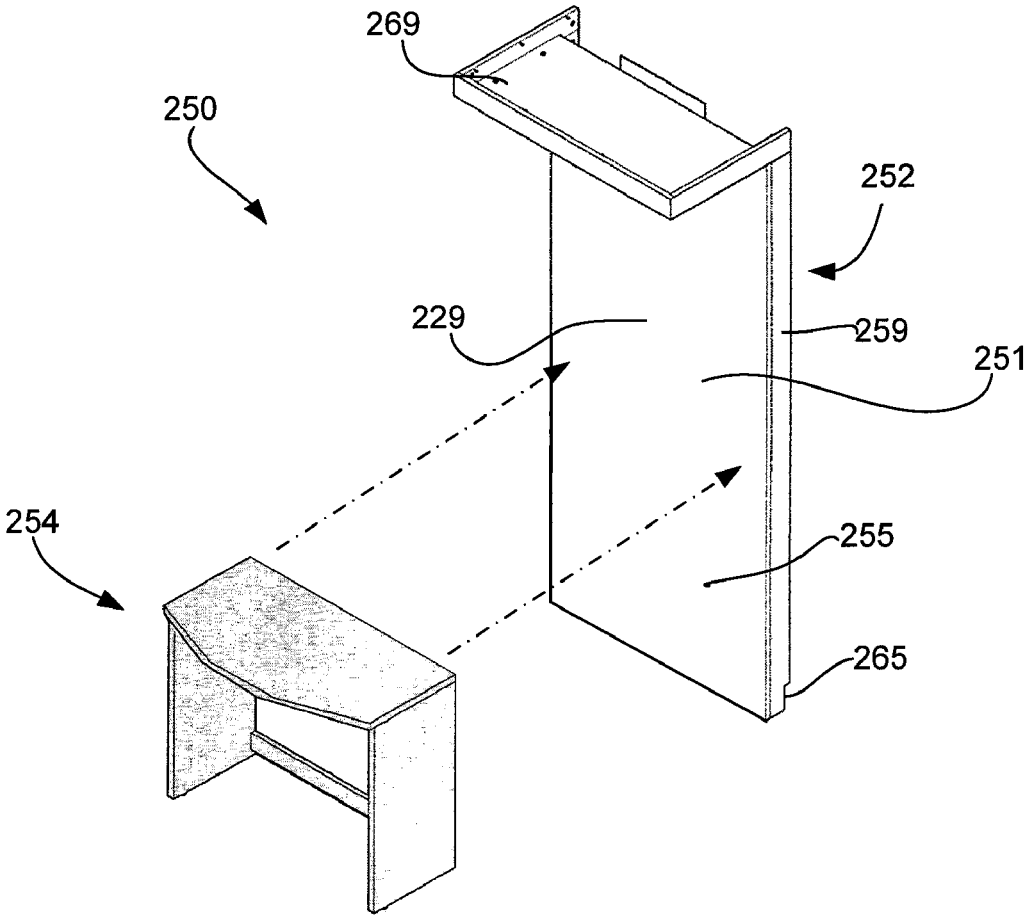
FIG. 21 is a partially exploded perspective of the assembly of FIG. 19.

With respect to back wall subassembly 251, referring to FIGS. 19-21, back wall subassembly 251 is similar to back wall subassembly 22 described above in that it includes a back wall member 255 that has oppositely facing front and back surfaces 229 and 249, respectively, and includes first and second elongated connectors members 257 and 259 that extend along side or lateral edges of back wall member 255 and from the rear surface 249 of back wall member 255. There are three primary differences between subassembly 251 and subassembly 22 described above. First, because subassembly 251 does not mount to a base (see again 18 in FIG. 2), the bottom end 265 of subassembly 251 has to extend down to a supporting floor surface. Where baseless wall subassemblies are to be used with wall subassemblies that include bases and where uniform canopy heights are desired, back wall member 255 and associated connector members 257 and 259 must have a height dimension H6 (see FIG. 20) that is longer than the height dimension H2 (see again FIG. 3) of back wall member 21 by the height dimension H1 (see again FIG. 2) of base 18. With these relative height dimensions, where assembly 250 shown in FIG. 19 is placed adjacent another assembly that has been constructed in the manner described above with respect to FIGS. 1 through 13, an overall configuration having canopies 269 and 22 at the same height (see FIGS. 33-36) can be provided.

Second, as best seen in FIG. 20, at bottom ends and along rear edges of connector members 257 and 259, members 27 and 259 form notches 271 and 273, respectively. Here, notches 271 and 273 akin to notch 19 shown in FIG. 13 are provided to accommodate power and data cables as well as base molding strips provided at the lower ends of permanent walls that subassembly 251 is to be placed adjacent.

Third, referring once again to FIG. 20, height adjustment glides 267 (only one shown) are provided at a bottom end 265 of subassembly 251, a first adjustment glide 267 mounted in the corner formed by rear surface 249 of member 255 and an internal surface of connector member 257 and a second adjustment glide (not illustrated) between rear surface 249 and an interior surface of connector member 259. Glides 267 at the bottom end 265 of subassembly 251 are provided to perform the same leveling function that the glides 42 described above provide in the case of wall subassembly 12 that includes base 18.

Figure 22:
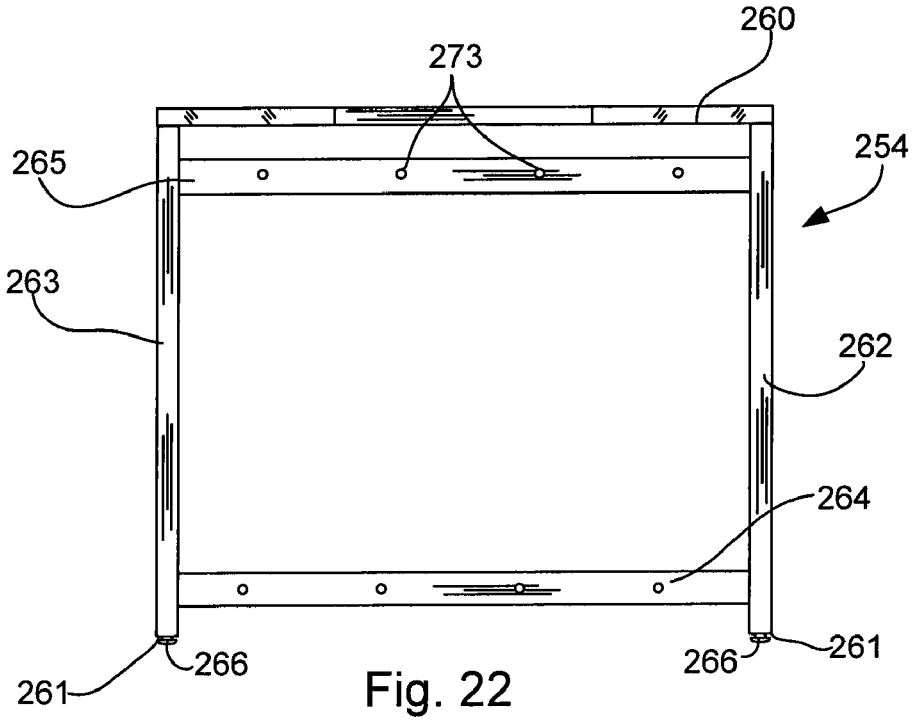
FIG. 22 is a front plan view of the desk unit of FIG. 19.

Referring still to FIGS. 19 and 21 and now also to FIG. 22, exemplary desk unit 254 includes, among other components, a unit top member 260, first and second leg member 262 and 263, a top back stringer 265, a bottom back stringer 266 and two height adjustment glides that are collectively identified by numeral 266. Each leg member 262 and 263 is similarly constructed and operates in a similar fashion and therefore, in the interest of simplifying this explanation, only leg member 263 will be described in detail. Leg member 263 is a rectilinear rigid panel type member that, among other edges, includes a bottom edge 261. In at least some embodiments, leg member 263 has a depth dimension (i.e., the dimension from front to rear) that is identical or substantially similar to the depth dimension D4 of exemplary unit 14 (see FIG. 9). Leg member 263, in at least some embodiments, has a height dimension H7 that, when combined with the thickness of unit top member 260, has an overall combined dimension that is equal to the height dimension H4 of unit 14 (see again FIG. 9) plus the height dimension H1 of base 18 so that, when subassembly 250 is placed adjacent a subassembly like subassembly 10 described above, the top surfaces of top members 190 and 260 are substantially coplanar.

Referring again to FIGS. 19 through 22, top member 260 has a width dimension W5 that is equal to the width dimension of back member 255. As shown, top member 260 is secured at the top ends of leg members 262 and 263 so that side edges of top member 260 are flush with external surfaces (not labeled) of leg members 262 and 263. Back stringer 265 is mounted between leg members 262 and 263 just below top member 260 and adjacent the rear edges of leg members 262 and 263. Similarly, stringer 264 is secured between leg members 262 and 263 near lower ends thereof and adjacent rear edges thereof. In at least some embodiments a plurality of predrilled holes 273 are provided in each of stringers 265 and 264 that are used when securing unit 254 to the front surface 247 of back wall member 255.

To mount unit 254 to subassembly 252, a rear end of unit 254 is moved up against the front surface 229 of member 255. Unit 254 is then centered on the wall subassembly 252 with the sides of the unit 254 flush with the external surfaces of connector members 257 and 259 and with bottom edges of members 262, 263, 251 and 265 substantially coplanar. Wood screws are inserted through stringers 265 and 264 to secure unit 254 to surface 229. Finally, glides 266 and 267 are adjusted to level assembly 252.

While the furniture assemblies described above with respect to FIGS. 1 through 22 may be used independently to provide a desk, drawer or shelving configuration, in particularly advantageous configurations, two or more of the assemblies described above can be combined to provide a larger furniture configuration and, in at least some cases, enhanced features. For example, referring now to FIG. 23, an exemplary furniture configuration 300 is illustrated that includes first and second assemblies 10*a* and 10*b* as well as a sliding door assembly 304. Here, assembly 10*a* is identical to assembly 10 described above with respect to FIGS. 1 through 13. Assembly 10*b* is similar to the embodiment described above with respect to FIGS. 1 through 13 but, instead of including drawer unit 14, includes the closet unit 14*d* shown in FIG. 18. Sliding door assembly 304 includes, among other components, a sliding door 306, a top track 308 and a bottom track 310.

Figure 23:
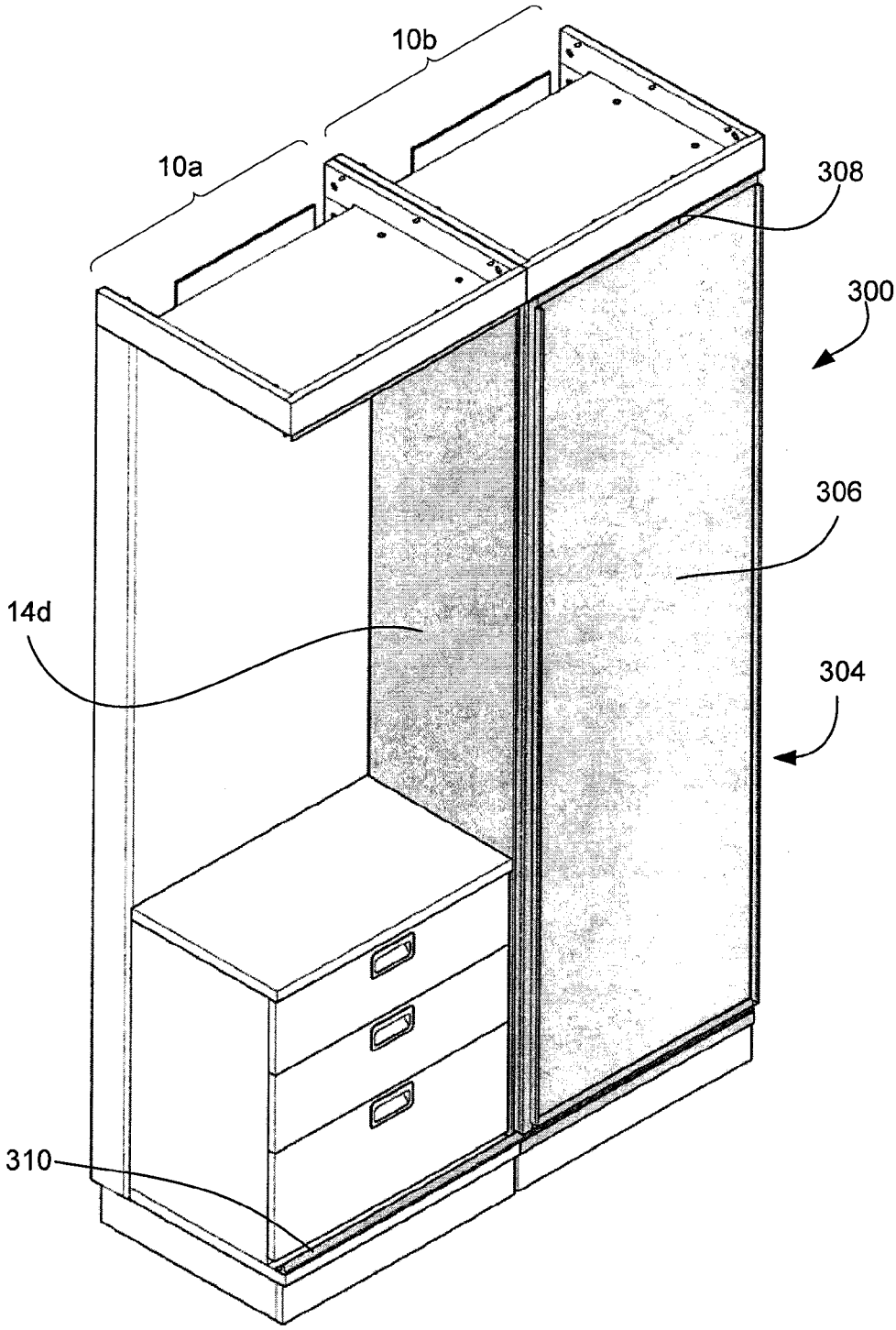
FIG. 23 is a perspective view of yet another furniture assembly that is consistent with at least some aspects of the present invention.
Figure 24:
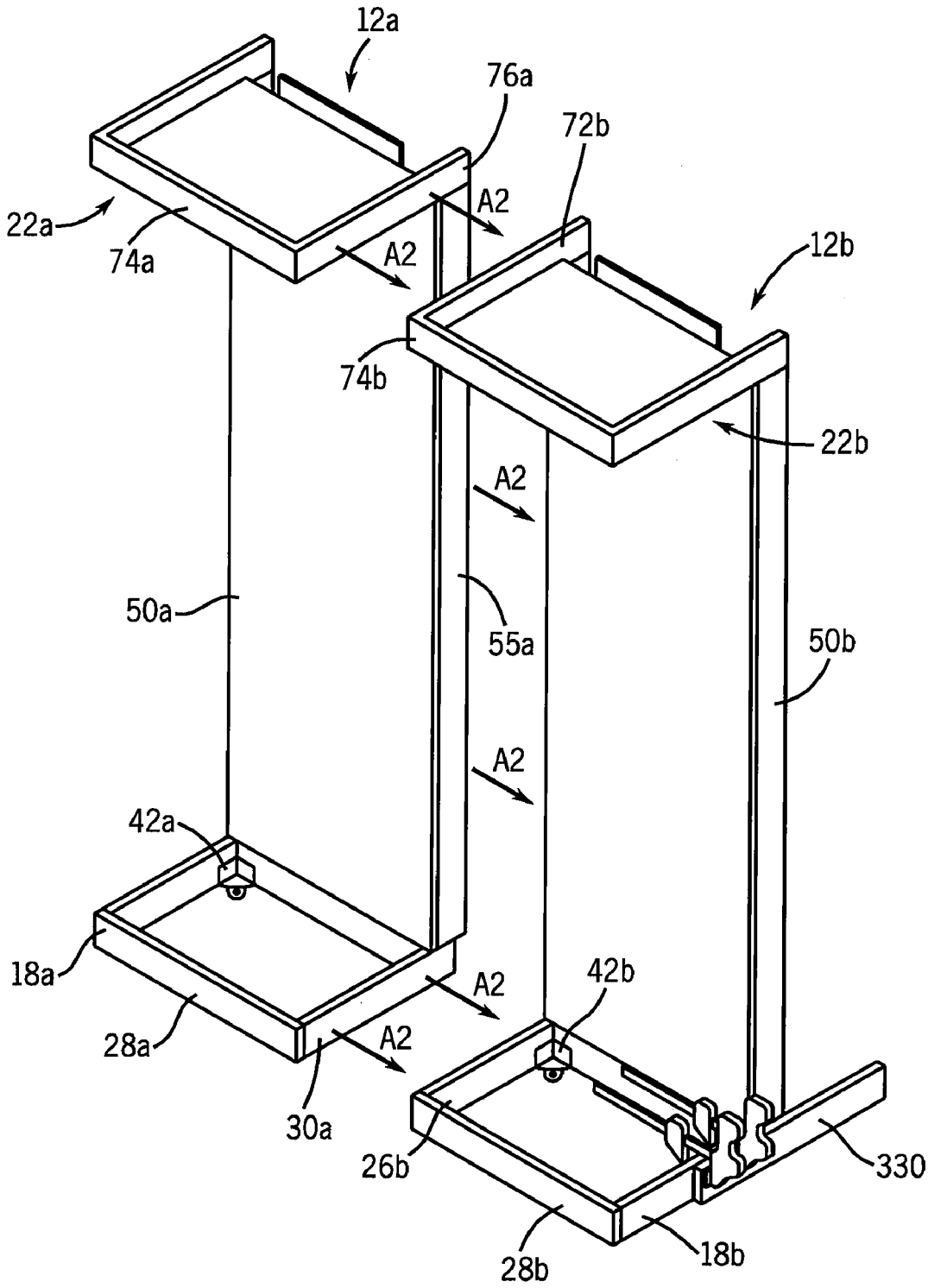
FIG. 24 is a perspective view the two wall subassemblies of FIG. 23 in an intermediate installation position.
Figure 25:
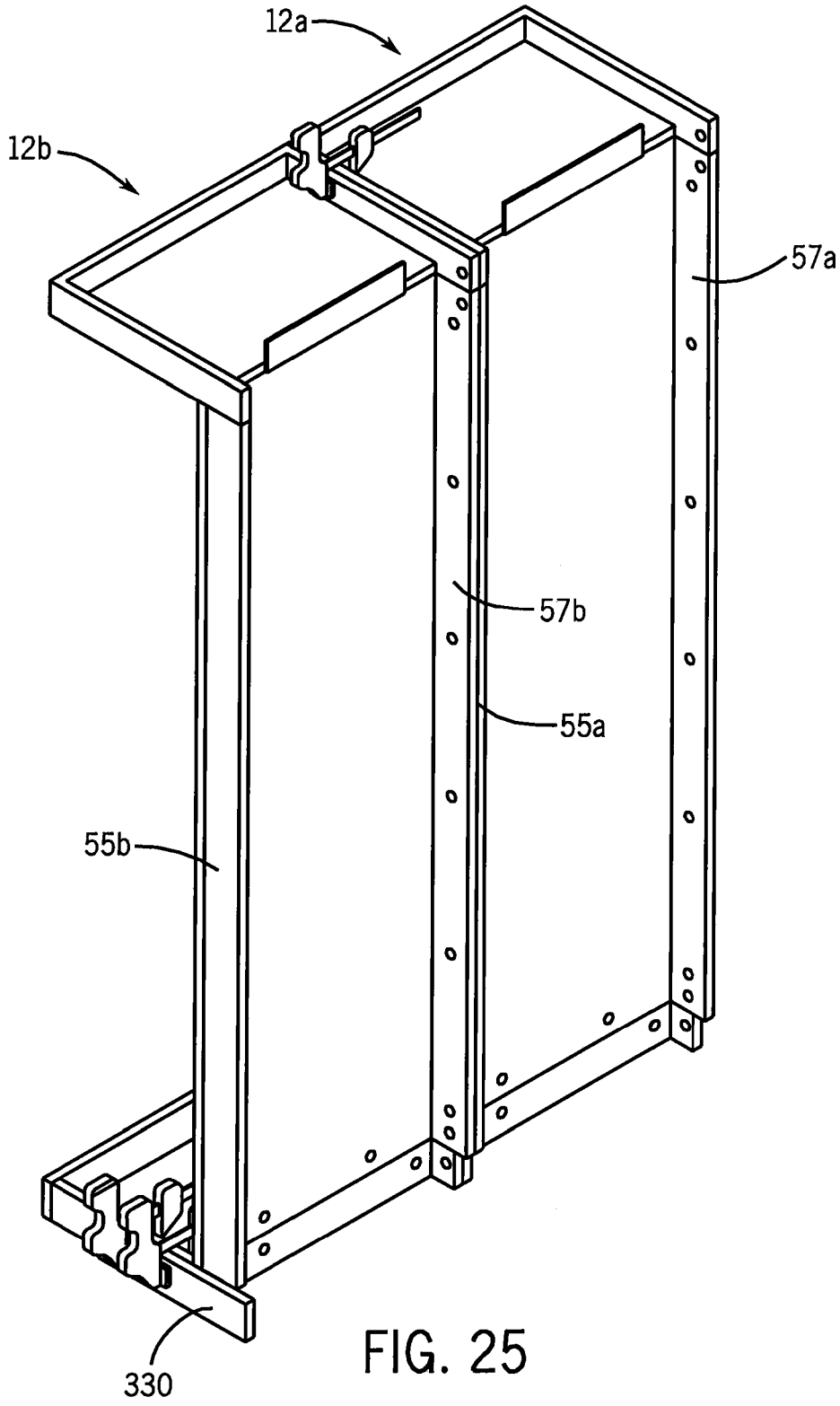
FIG. 25 is a rear perspective view of the wall subassemblies of FIG. 24, albeit connected together.

Assembly of configuration 300 will now be described. Referring still to FIG. 23 and now also to FIG. 24, assembly 10*a* includes wall subassembly 12*a* while assembly 10*b* includes wall subassembly 12*b* which is substantially similar to subassembly 12*a*. After subassemblies 12*a* and 12*b* have been constructed in the manner described above, a next step in assembling configuration 300 is to secure subassembly 12*a* to subassembly 12*b*. To this end, initially, a piece of scrap board 330 may be clamped to the base of subassembly 12*b* to increase the stability of subassembly 12*b*. Next, subassembly 12*a* is moved into position adjacent subassembly 12*b* as indicated by arrows A2 in FIG. 24 so that canopy wall member 76*a* abuts canopy member 72*b*, connector member 55*a* abuts connector member 57*b* (see also FIG. 25) and base wall member 30*a* is adjacent and slightly spaced from base member 26*b*. The abutting and adjacent members are aligned with each other as shown in FIG. 25 and hand clamps may be used to temporarily secure those members together. Before securing the abutting members, the front faces of canopy wall members 74*a* and 74*b* must be flush. In addition, the front surfaces 50*a* and 50*b* of back wall members must be flush. Moreover, the front faces of the toe boards formed by base wall members 28 and 28*b* should be flush and slightly spaced from each other.

Continuing, holes are drilled through the abutting canopy members 76*a* and 72*b* and the canopies are secured together using bolts, washers and nuts. In at least some embodiments, two holes and two bolt, nut and washer combinations will suffice to secure the canopies together. Next, holes are drilled through the abutting connecting member 55*a* and 57*b* and bolt, washers and nuts are used to secure the connector member 55*a* and 57*b* together. In at least some embodiments, four holes and bolt, washer and nut combinations will suffice to secure the connector members together. Continuing, hand clamps can be removed from the abutting members.

After wall subassemblies 12*a* and 12*b* have been connected as illustrated in FIG. 25, scrap board 330 can be removed and the combined subassembly shown in FIG. 25 can be moved into a use position against a permanent or semi-permanent wall structure with the rear edges of connector members 55*b*, 55*a*, 57*b* and 57*a* generally abutting against the front surface of the wall. Although not shown, felt or other strips may be adhered to the rear edges of members 55*a*, 55*b*, 57*a* and 57*b* prior to movement against the permanent wall to minimize defacing of the wall surface.

Figure 26:
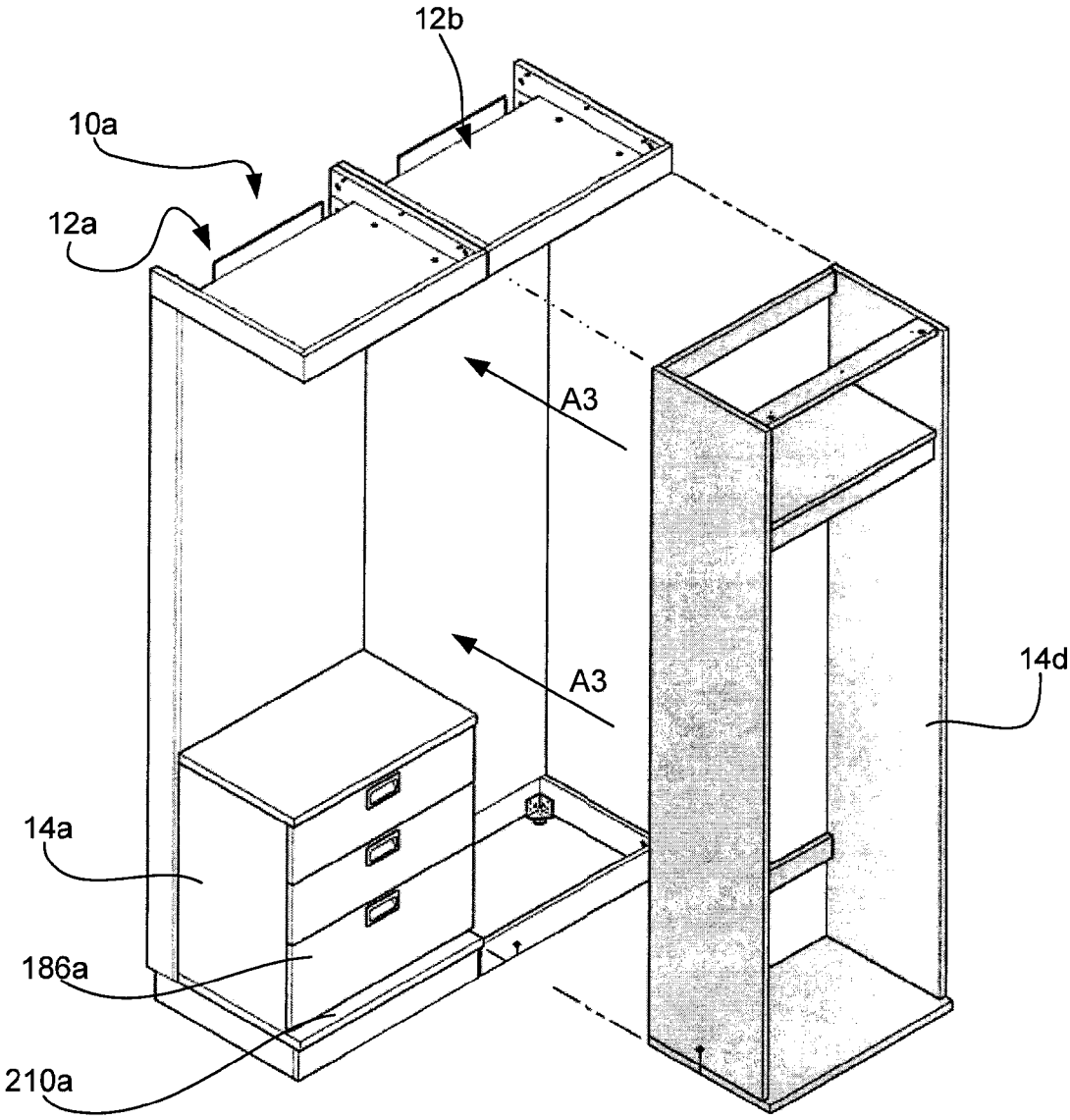
FIG. 26 is a perspective view showing an intermediate installation state for the assembly of FIG. 23.

Once a subassembly shown in FIG. 25 has been moved in to a use position, height adjustment glides 42*a* and 42*b* can be adjusted to level the top edges of bases 18*a* and 18*b*. After bases 18*a* and 18*b* have been leveled, drawer unit 14*a* can be installed within the receiving space defined by subassembly 12*a* in the manner described above with respect to FIG. 13. Similarly, closet unit 14*d* can be slid into the receiving space formed by the subassembly 12*b* as indicated by arrows A3 (see FIG. 26) and can be secured therein using screws.

Figure 27:
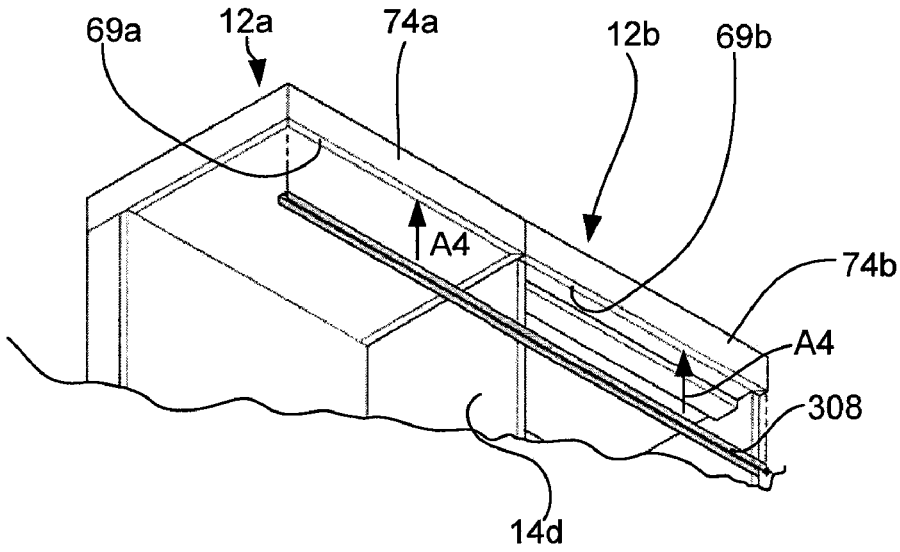
FIG. 27 is a partial perspective view showing installation of the top track of FIG. 23.
Figure 28:
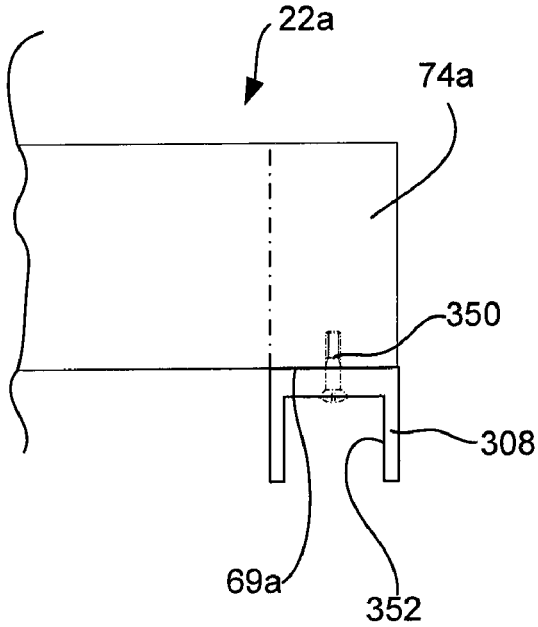
FIG. 28 is an end view showing the track of FIG. 23.

Referring once again to FIG. 23 and now also to FIGS. 27 and 28, top track 308 includes an elongated straight track member that, in cross-section, is generally U-shaped forming an inner channel 358. Track 308 is placed against the bottom edge surfaces 69*a* and 69*b* of canopy wall members 74*a* and 74*b* as indicated by arrows A4 in FIG. 27 and is secured there via a plurality of screws, one screw shown in phantom in FIG. 28 and identified by numeral 350. Once installed, the channel 352 formed by track 308 opens downwardly as shown in FIG. 28. In the illustrated embodiment, track 308 extends the entire combined length of members 74*a* and 74*b*.

Figure 29:
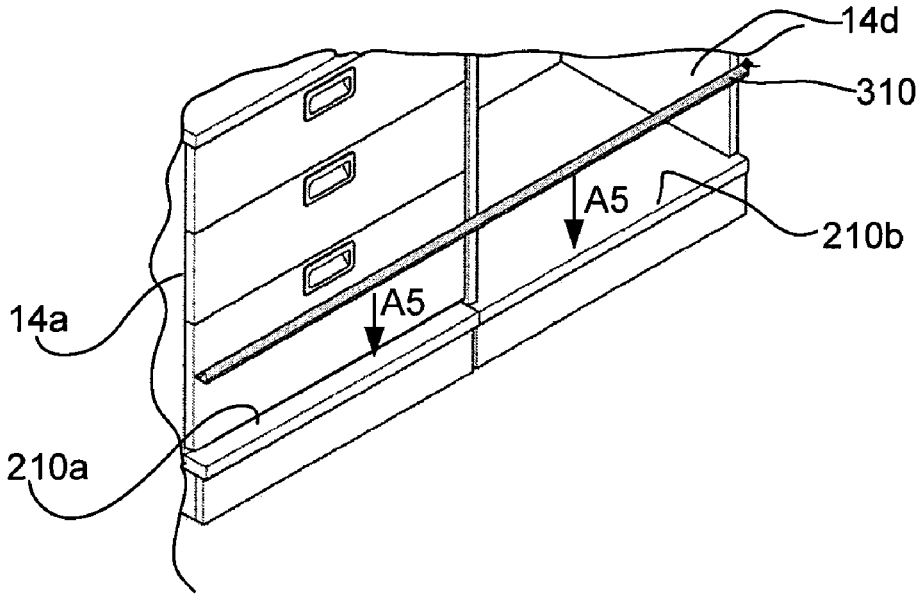
FIG. 29 is a partial perspective view showing installation of the bottom track of FIG. 23.

Referring now to FIGS. 23, 29 and 30, bottom track 310 is an elongated rigid member which is generally L-shaped in cross-section. Bottom track 310 is installed by placing the track 310 against the exposed top surfaces 210*a* and 210*b* formed by the bottom members (see 192*a* in FIG. 30) of units 14*a* and 14*b* as indicated by arrows A5 in FIG. 29 and securing the track against those exposed surfaces via a plurality of screws, one screw indicated by numeral 260 and shown in phantom in FIG. 30.

Referring now to FIGS. 23 and 31, sliding door member 306 is a rectilinear rigid door that may be finished in any of several different manners including a wood exterior surface, a laminated exterior surface, mirror surface, a writing board surface, etc. Along a top edge and adjacent each of the top corners of door member 306, the door also includes several components that extend upward therefrom to be received within the top track 308. The upwardly extending components at each corner include a pin 372, a roller wheel 374 and an anti-dislodgement bolt 376. Pin 372 is closest to a side edge of the door 306 and, as the label implies, is simply a rigid pin extending upward from the top edge 309 of door 306. Anti-dislodgement bolt 376 extends substantially perpendicular to top edge 309 and can be rotated about a vertical axis to increase or decrease the length of bolt extending from edge 309. Here, by adjusting the extending length of bolt 376, an installer can insure that the door 306 will not become dislodged from the top track 308. In at least some embodiments, bolts 376 should be adjusted so that a clearance dimension C1 between the top end of the bolt and the downward facing surface of the channel 352 (see again FIG. 28) is 3/32 of an inch or less after member 306 is installed.

Roller wheel 374 is mounted on an axle that extends substantially perpendicular to edge 309 for rotation about a vertical axis and is sized to be generally received within channel 352 to facilitate smooth movement of door 306. Although not illustrated, standard off the shelf roller type wheel assemblies are provided along the lower edge of door 306 that are receivable within the channel 311 formed by track 310 shown in FIG. 30.

To install door 306, the pins, roller wheels and bolts on the top of the door and the rollers on the bottom of the door are aligned with the channels 352 and 311 formed by tracks 308 and 310, respectively, and door 306 is slid into the space between the tracks 308 and 310. Once door 306 is supported by tracks 308 and 310, referring to FIG. 32, end stop members 370 (only one shown) are inserted into the channel 352 as indicated by arrow A6 at each end of the top track 308 and are secured therein via screws 372. The end stop members 379 may be formed of any material but, in particularly advantageous embodiments, are rubber stop members. The illustrated end stop member 370 forms a channel 379 that faces the pins 372 (see again FIG. 31) extending from the top edge 309 of the door 306 which is sized to receive the pin 372 thereby holding the door in a position at the end of the track 308 unless affirmatively moved to another position.

Figure 33:
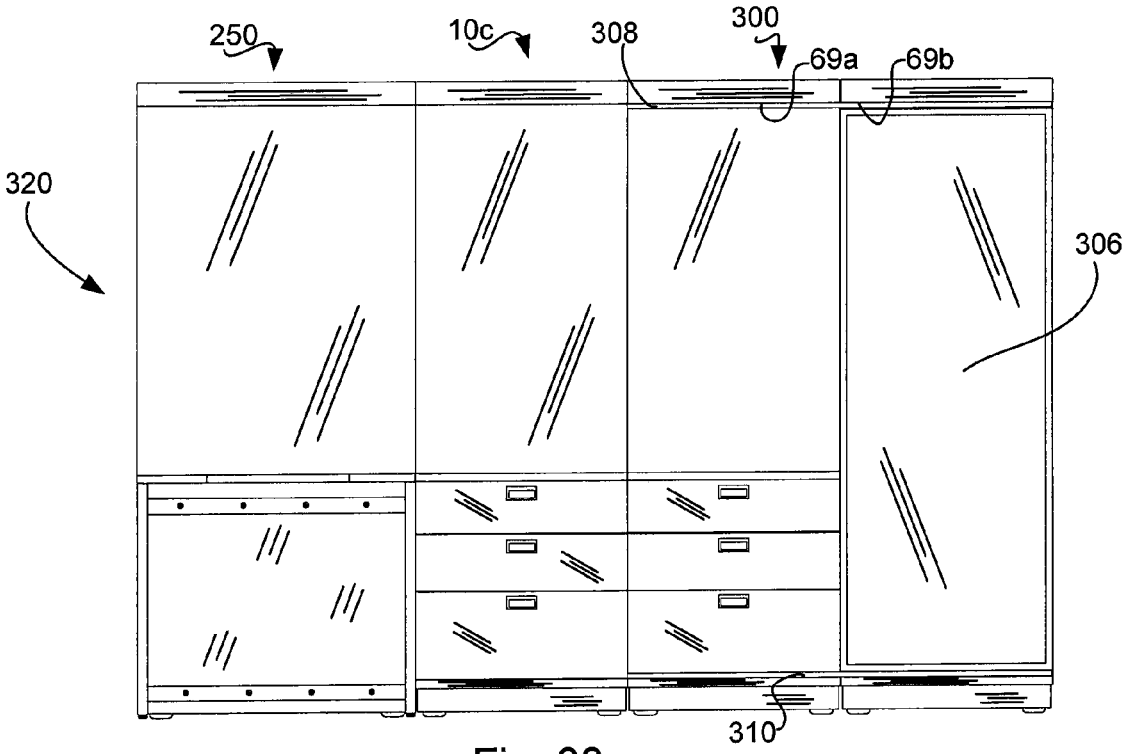
FIG. 33 is a perspective view showing multiple furniture assemblies being configured together.
Figure 34:
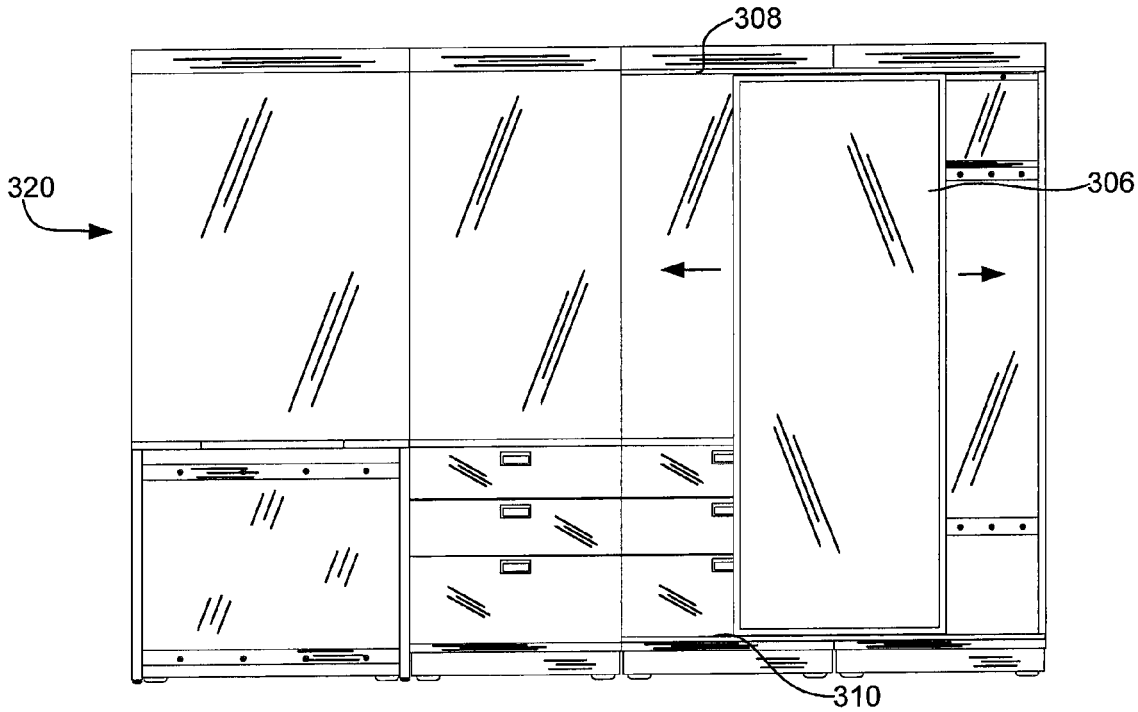
FIG. 34 is a front plan view of the assembly of FIG. 33 with the sliding door in a closed position.

Referring once again to FIG. 23, while a configuration 300 is described that includes two furniture assemblies 10*a* and 10*b*, it should be appreciated that the inventive furniture system enables an installer to cobble together more than two assemblies to configure even larger furniture configurations. To this end, referring now to FIG. 33, a configuration 320 is shown where assemblies 250 and 10*c* are being added to the assembly 300 to create the relatively large furniture configurations shown in FIGS. 34 and 35. In FIG. 33, assembly 250 is identical to the assembly described with respect to FIGS. 19 through 22, assembly 10*c* is identical to the assembly 10 described above with respect to FIGS. 1 through 13 and assembly 300 is identical to the assembly described above with respect to FIGS. 23 through 32. Once assembled, assembly 320 provides a desk unit and two drawer units where the top surfaces of each of those units is at the same height so that a credenza like configuration results. In addition, assembly 320 provides a closet unit for storage of other items and includes a sliding door 306 that can be used to close the closet unit when desired.

Figure 35:
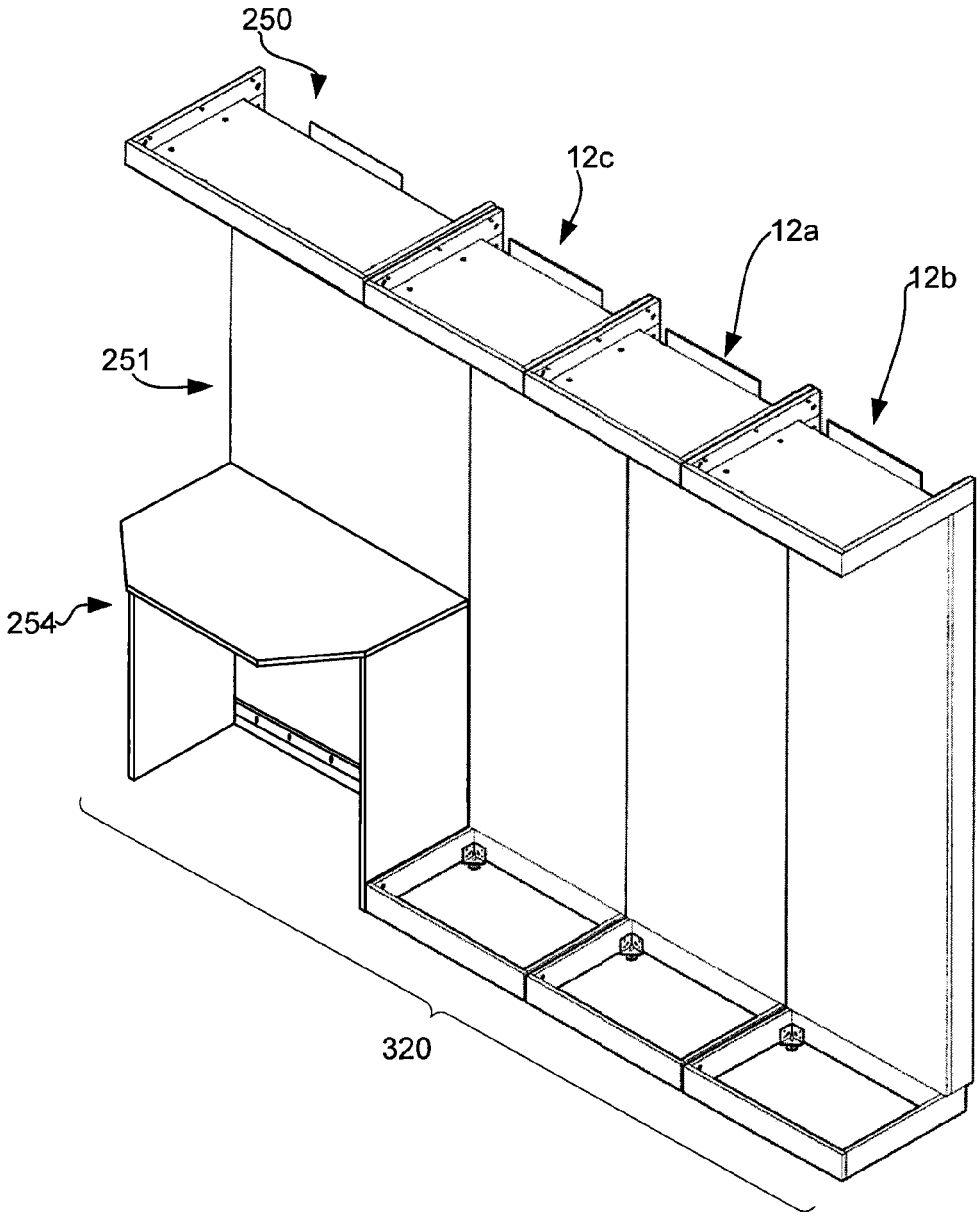
FIG. 35 is similar to FIG. 34, albeit showing the sliding door in a partially open position.

To assemble assembly 320, referring to FIG. 35, after wall subassemblies 251, 12*a*, 12*b* and 12*c* have been assembled as described above with respect to FIGS. 3 through 6, subassemblies 12*a*, 12*b* and 12*c* are secured together in the manner described above with respect to FIGS. 24 and 25. Next, subassembly 250, including wall subassembly 251 and desk unit 254, are assembled as described above with respect to FIGS. 19 through 22. Continuing, the subassembly 250 is secured to subassembly 12*c* via screws to connect abutting canopy and connector members resulting in the intermediate wall assembly shown in FIG. 35.

Figure 36:
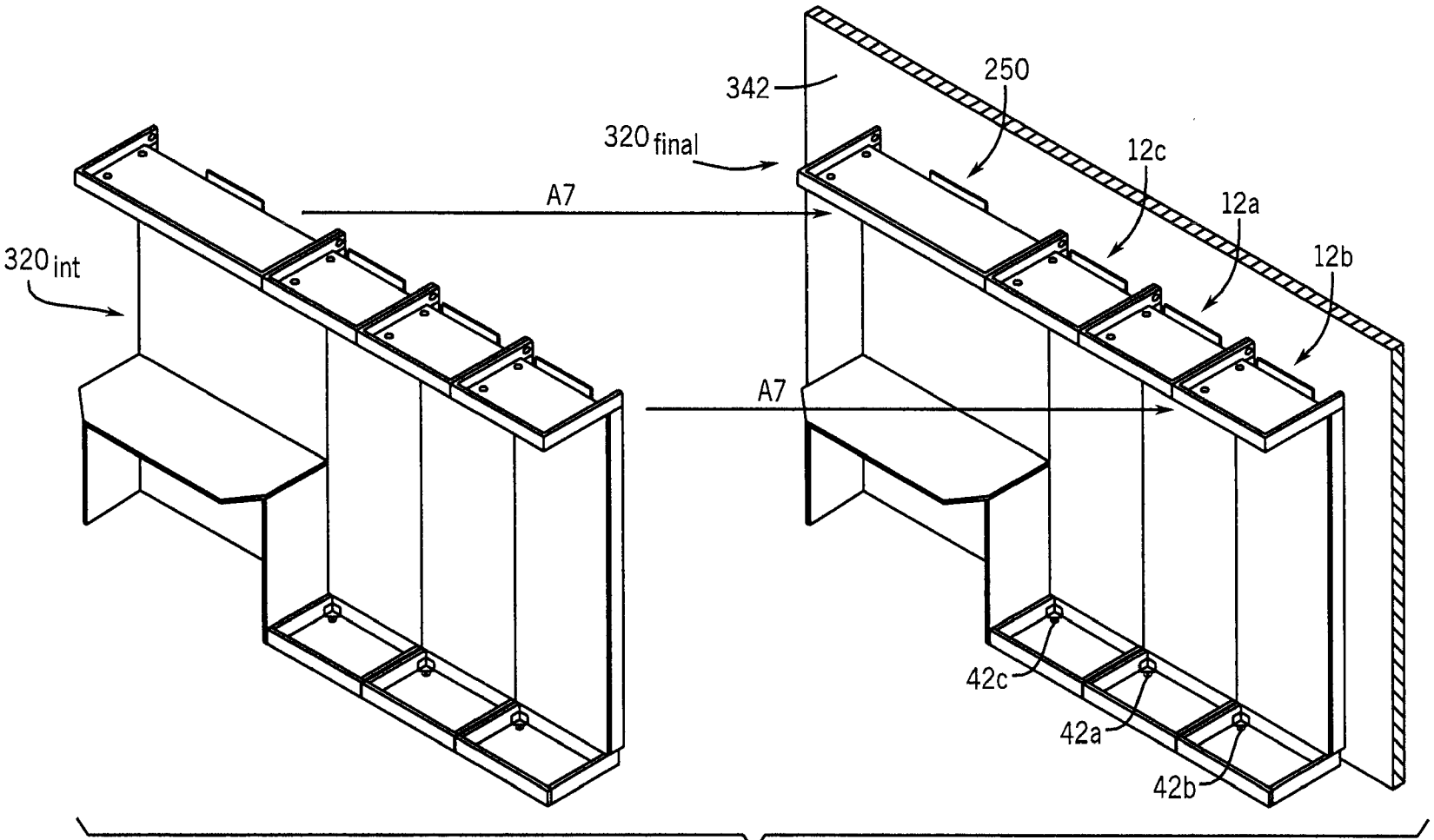
FIG. 36 is a perspective view showing the subassembly of FIG. 35 in an initial position and in a final use position against a wall.

Once the FIG. 35 subassembly has been constructed, referring to FIG. 36, the subassembly is moved from its initial or intermediate assembly position indicated by numeral $\mathbf{320}_{int}$ to its final use position $\mathbf{320}_{final}$ as indicated by arrows A7 against the flat surface of a permanent or semi permanent wall 342. Once assembly 320 is in the final use position, the height adjustment glides 42*a*, 42*b* and 42*c* as well as the glides on the bottom of subassembly 250 are adjusted to level and support assembly 320. Thereafter, the furniture units and sliding door assembly are installed within the receiving spaces formed by subassemblies 12*a*, 12*b*, and 12*c* to complete the configuration.

According to at least one additional inventive aspect, a replaceable mounting board assembly as contemplated that may be used with any of the wall subassemblies described above or, indeed, with any other type of permanent or semi permanent wall structure that includes a flat and exposed wall surface. Herein, in the interest of simplifying this explanation, the mounting board subassembly will be described in the context of the exemplary furniture assembly 400 shown in FIG. 37 that includes a wall subassembly 401 akin to the subassembly described above with respect to FIGS. 2 through 8, a bench furniture unit 14*b*, like the one described above with respect to FIG. 16 and a mounting board assembly 406. As shown, wall subassembly 401 includes, among other components, a back wall member 402 that forms a front surface 404. Mounting subassembly 406 is mounted to surface 404.

Referring also to FIGS. 38 through 41, mounting subassembly 406 includes a disposable mounting board member 407, first through fourth mounting brackets 412*a*, 412*b*, 412*c* and 412*d*, respectively, and two Velcro pads 416*a* and 416*b*. Board 407 includes oppositely facing front and rear surfaces 408 and 410, respectively, has top and bottom edges 417 and 419, respectively, and has a generally rectangular and planar shape. Board 407 is formed of a material that is rigid that accessories can easily be mounted to using screws or bolts. To this end, the board may be formed of various rigid materials including but not limited to wood, laminate, Corrian type materials, plastic, etc.

Figure 38:
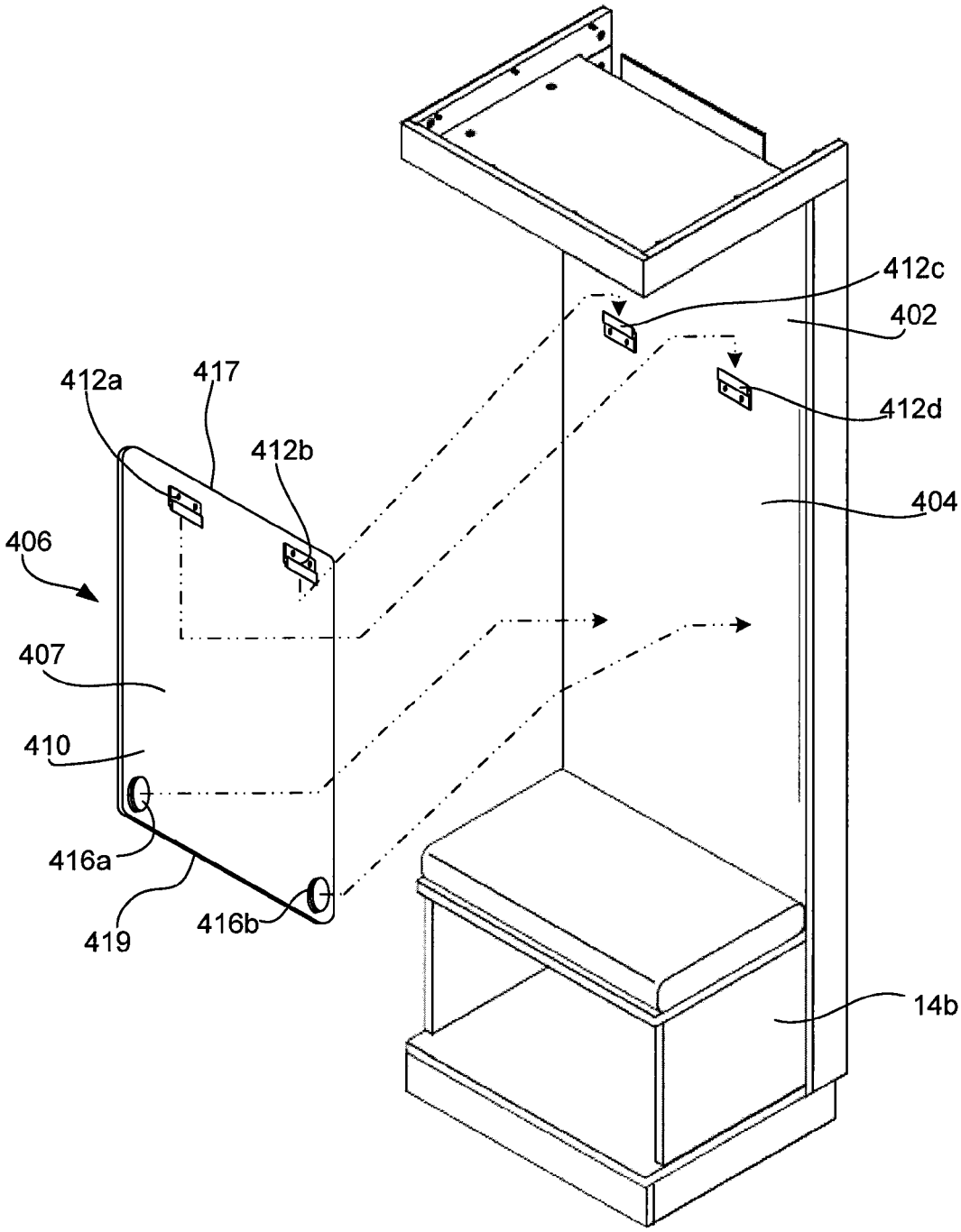
FIG. 38 is a perspective view of the assembly of FIG. 37, albeit where the disposable mounting board has been removed from a wall subassembly.
Figure 39:
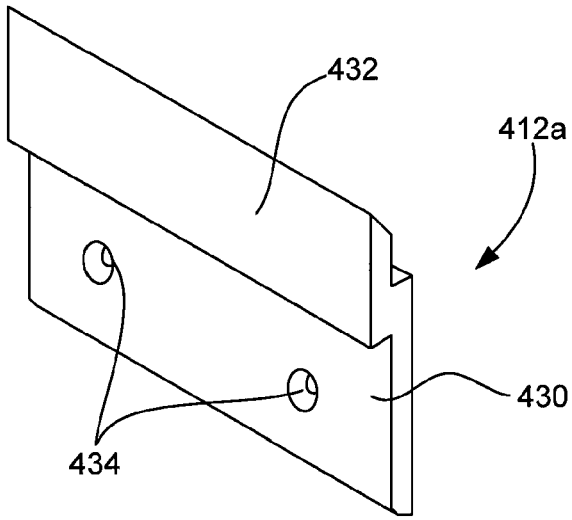
FIG. 39 is a perspective view of one of the brackets of FIG. 38.
Figure 41:
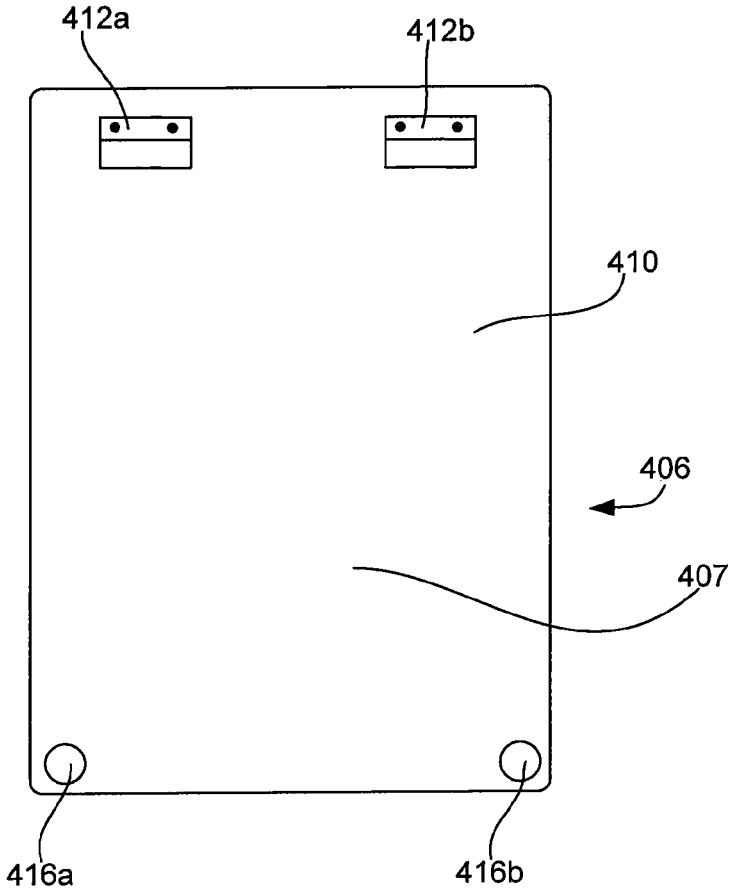
FIG. 41 is a back plan view of the board shown in FIG. 38.

Referring to FIGS. 38, 39 and 41, each of the brackets 412*a* through 412*d* has a similar configuration and operates in a similar manner and therefore, in the interest of simplifying this explanation, only bracket 412*a* will be described in detail. Bracket 412*a* is a rigid bracket including first and second substantially flat plates 430 and 432 that are integrally formed but offset in adjacent planes. The first plate 430 forms two mounting holes 434. A distal end (not labeled) of second plate 432 is chamfered to help guide a bracket to be secured thereto into a securing position.

Figure 40:
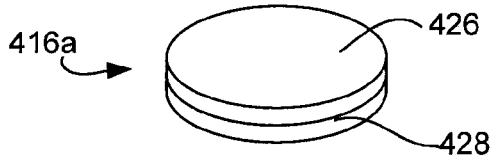
FIG. 40 is a perspective view of one of the Velcro pads of FIG. 38.

Referring now to FIGS. 38, 40 and 41, each of the Velcro or compliments Velcro subassemblies pads 416*a* and 416*b* is similar and therefore only pad 416*a* will be described here in detail. Referring specifically to FIG. 40, pad 416*a* includes first and second complementary connecting pad members 426 and 428 that secure together as well known in the art. Each of pads 426 and 428 includes a back surface that adhesive is applied to. Prior to securing the pads 416*a* and 416*b*, plastic or paper sheets cover the adhesive so that the pads can be handled in an easy manner.

Figure 37:
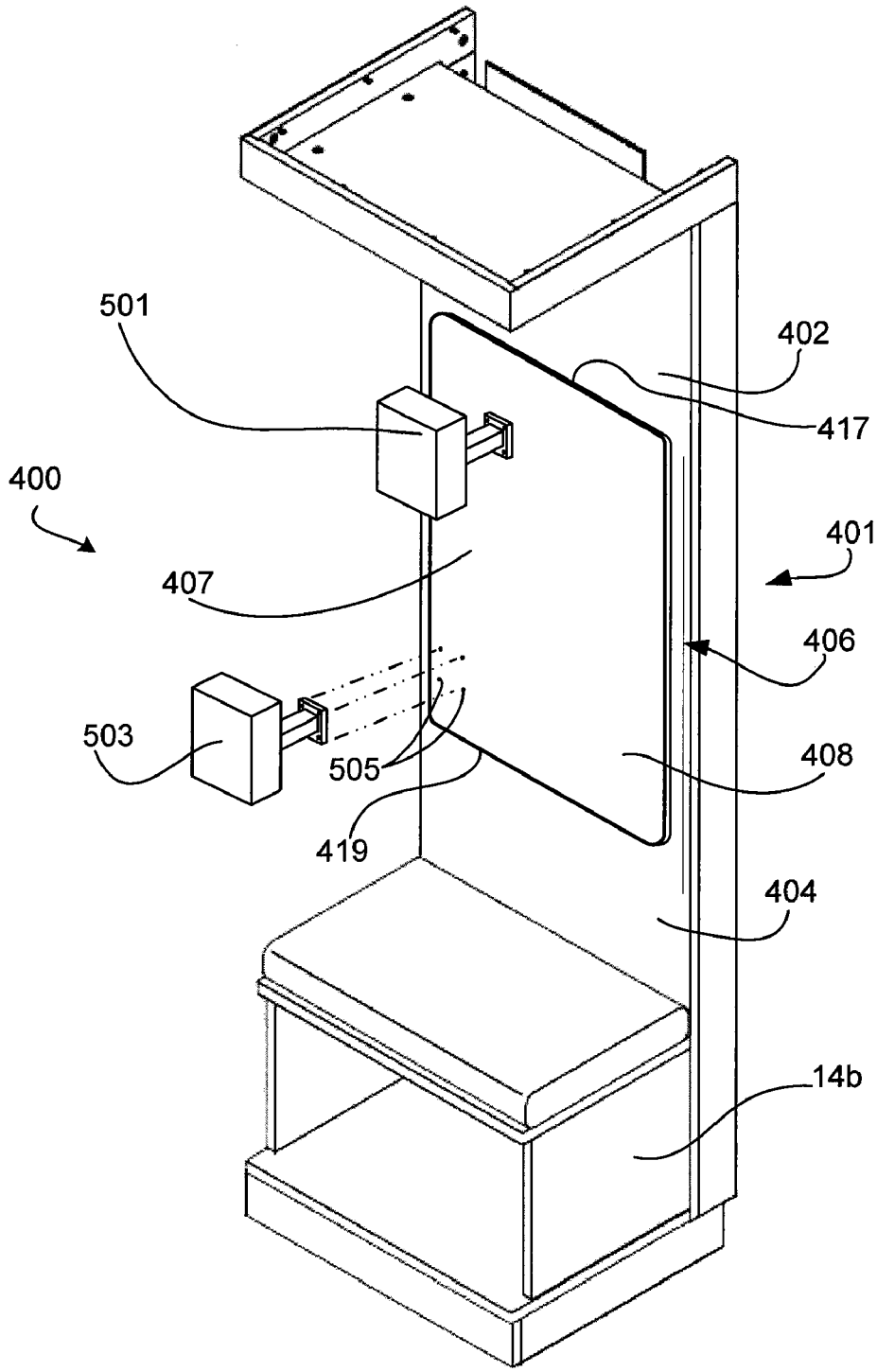
FIG. 37 is a perspective view of a furniture unit including a disposable mounting board consistent with at least some aspects of the present invention.

Referring once again to FIGS. 38 through 41, the first and second brackets 412*a* and 412*b* are mounted to rear surface 410 of disposable board 407 adjacent top edge 417 thereof and pads 416*a* and 416*b* are adhered to rear surface 410 adjacent the bottom two corners and along bottom edge 419 of board member 407. The third and fourth brackets 412*c* and 412*d* are secured via screws to the front surface 404 of back wall member 402 at locations where they will simultaneously align with brackets 412*a* and 412*b* during mounting. Next, with the adhesive on Velcro pads 416*a* and 416*b* exposed, an installer raises board 407 and moves that board to a location adjacent surface 404 where brackets 412*a* and 412*b* reside above brackets 412*d* and 412*c*, respectively, and lowers board 407 until the brackets 412*a* and 412*b* are hooked on brackets 412*d* and 412*c*. Once the brackets are hooked, the installer simply rotates the lower end of board 407 towards surface 404 until the exposed adhesive on pads 416*a* and 416*b* contact surface 404. Once the lower end of board 407 is pressed against surface 404, the adhesive adheres and the board 407 is mounted as shown in FIG. 37.

A person can mount accessories and other devices to any portion of the front surface 408 of board 407 via screws or bolts. Two exemplary accessories are shown schematically at 501 and 503 where mounting holes that deface front surface 408 are shown at 505. After board 407 has been defaced over the course of time, a user can replace the board 407 by simply pulling outward on the bottom end of board 407 until the Velcro pads release and then lifting upwardly on board 407 until the brackets are disconnected. Thereafter, the user can remove the brackets 412*a* and 412*b* from the rear surface of board 407, can attach those brackets to the rear surface of a second replacement board and can attach the replacement board to surface 404 in the manner describe above.

One or more specific embodiments of the present invention have been described above. It should be appreciated that in the development of any such actual implementation, as in any engineering or design project, numerous implementation-specific decisions must be made to achieve the developers' specific goals, such as compliance with system-related and business related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Thus, the invention is to cover all modifications, equivalents, and alternatives falling within the spirit and scope of the invention as defined by the following appended claims. For example, while embodiments have been described above that include rectilinear bases (see 18 in FIG. 2) and canopies (see 22 in FIG. 2), other shapes are contemplated. For instance, round, elliptical, square and other base shapes may be provided for certain applications. Similar odd shapes may be provided for canopy 22 where an assembly (e.g., 10 in FIG. 1) is to be used independent of other similar assemblies. Where an assembly is to be cobbled together to form a larger wall/furniture assembly, in at least some embodiments, the canopies should have at least straight side edges to facilitate connection between assemblies.

In addition, while the above assemblies include canopies, in at least some embodiments, canopies may be foregone in at least some assemblies or altogether.

Moreover, other connector or mounting means or mechanical structures may be provided for securing the mounting board shown in FIG. 38 to a wall surface and assembly 406 may be used in other applications where it is mounted to a permanent wall surface.

Furthermore, in at least some embodiments, it is contemplated that a sealing base board strip formed of rubber or the like may be installed on the front surfaces of toe boards (see 28 in FIG. 2) after assembly is complete. Where two or more wall subassemblies are secured together, the strip can seal and close the gap between the adjacent bases thereby eliminating a space for debris and germs to gather.

In addition, although not mentioned above, referring to FIG. 33, it should be appreciated that furniture units and associated wall subassemblies having several standard width dimensions are contemplated. To this end, assembly 250 is shown as wider than assembly 10*c* while assembly 10*c* has a width dimension that is identical to the widths of each of assemblies 10*a* and 10*b* (see also FIG. 23) that make up assembly 300. In an advantageous kit, furniture units and associated wall subassemblies may be provided in standard 24 and 36 inch widths.

Moreover, while furniture units (e.g., 14, 14*a*, 14*b*, etc.), are all shown in the figures as being a single height (with the exception of closet unit 14*d*), in at least some embodiments a kit of furniture parts may include furniture units that have multiple standard heights. For instance, in the case of desk unit 254 (see FIG. 19), unit 254 may be provided in both standing and sitting heights. Storage units may be provided in two or three different heights as well.

In addition, top/upper furniture storage units (see 16 in FIG. 1) may be added to any of the assemblies described above that include a lower desk or storage unit.

Furthermore, while the wall and canopy fasteners are described above as being bolt/nut combinations and specific types of fasteners (e.g., dowels, pin and quarter turn anchors, etc.) are described above for securing back wall subassemblies, bases and canopies, it should be appreciated that any other mechanical fasteners known in the art or even adhesive in some cases may be employed to fasten kit components.

To apprise the public of the scope of this invention, the following claims are made:

What is claimed is:

1. A free standing furniture apparatus comprising:

a furniture unit having a unit height dimension and including at least one storage compartment;

a base including a base wall having a base height dimension and first and second separated base wall ends, the base wall at least in part circumscribing a base space where the base wall includes a top edge surface that resides substantially in a single edge plane; and a back wall member supported by the base wall proximate the first and second ends of the base wall and extending substantially vertically upward from the base wall and substantially perpendicular to the single edge plane so that there is a receiving space that is unobstructed by the back wall member and that is above the base space for receiving the furniture unit, the back wall member having a back wall height dimension that is greater than the unit height dimension so that at least a portion of the back wall member is observable above the furniture unit when the furniture unit is received within the receiving space;

wherein the furniture unit is receivable on the top edge surface of the base wall within the receiving space;

wherein the furniture unit includes a top member and first and second side wall members that support the top member and that space the top member from the base when the furniture unit is received on the top edge surface of the base wall, each of the first and second side wall members having a bottom edge spaced from the top member and wherein the furniture unit further includes a front stringer member that extends between the first and second side wall members proximate the bottom edges of the first and second side wall members.

2. The apparatus of claim 1 wherein the base wall includes at least first, second and third substantially flat and planar base wall members where the first and second base wall members are parallel and spaced apart and form the first and second ends of the base wall and wherein the third base wall member extends between the ends of the first and second base wall members opposite the first and second ends of the base wall and is substantially perpendicular to each of the first and second base wall members.

3. The apparatus of claim 2 wherein the back wall member includes a substantially rectangular and planar member that includes oppositely facing front and rear surfaces where the front surface faces the receiving space.

4. The apparatus of claim 3 further including a substantially flat planar rear base member that traverses the distance between the first and second ends of the base wall and that is substantially perpendicular to the first and second base wall members.

5. The apparatus of claim 4 wherein the base wall is mounted to the rear base member.

6. The apparatus of claim 1 wherein the base wall includes an internal surface that defines the base space and wherein the furniture unit includes at least one cleat extending from the bottom thereof that is adjacent at least a portion of the internal surface of the base wall when the furniture unit is supported on the top edge of the base wall.

7. The apparatus of claim 1 wherein the back wall member includes a top end opposite the base wall, the assembly further including a canopy supported at the top end of the back wall member that extends above the receiving space and that is spaced above the furniture unit when the unit is received in the receiving space.

8. The apparatus of claim 1 including an assembly for mounting accessories to a front wall surface of a wall member, the assembly comprising:

a planar board member including substantially oppositely facing and flat front and rear surfaces;

at least a first quick release fastener for releasably securing the board member to the front wall surface so that the front surface of the board member is accessible for mounting accessories;

wherein the fastener facilitates release of the board member from the wall front surface so that the board member can be disposed of and replaced by a new board member after the front surface of the board member is defaced.

9. The apparatus of claim 8 further including at least one accessory mounted to the front surface of the board member.

10. The apparatus of claim 1 wherein the base wall includes at least first, second substantially flat and planar base wall members where the first and second base wall members are parallel and spaced apart and form the first and second ends of the base wall and wherein the first and second base wall members form at least a portion of the top edge surface that receives the furniture unit.

11. The apparatus of claim 2 wherein the third base wall member traverses the distance between the first and second base wall members and wherein the first, second and third base wall members form at least a portion of the top edge surface that receives the furniture unit.

12. The apparatus of claim 6 wherein the cleat is received within the base space when the furniture unit is received on the top edge surface.

13. The apparatus of claim 1 wherein the furniture unit includes at least one drawer.

14. The apparatus of claim 1 wherein the furniture unit includes at least one cabinet.

15. The apparatus of claim 1 wherein the back wall member includes top and bottom edges and first and second lateral edges and wherein the assembly further includes first and second connectors mounted to the rear surface of the back wall member adjacent the first and second lateral edges for connecting the apparatus to a similar apparatus.

16. The apparatus of claim 15 wherein each of the first and second connector members includes an elongated planar rectangular member that extends from the rear surface of the back wall member and substantially along the entire height dimension of the back wall member so that the back wall member and the first and second connector members together form a channel adjacent the rear surface of the back wall member.

17. A free standing furniture apparatus comprising:

a furniture unit having a unit height dimension and including at least one storage compartment;

a base including a base wall having a base height dimension and first and second separated base wall ends, the base wall at least in part circumscribing a base space where the base wall includes a top edge surface that resides substantially in a single edge plane, wherein the base wall includes at least first, second and third substantially flat and planar base wall members where the first and second base wall members are parallel and spaced apart and form the first and second ends of the base wall and wherein the third base wall member extends between the ends of the first and second base wall members opposite the first and second ends of the base wall and is substantially perpendicular to each of the first and second base wall members; and a back wall member supported by the base wall proximate the first and second ends of the base wall and extending substantially vertically upward from the base wall and substantially perpendicular to the single edge plane so that there is a receiving space that is unobstructed by the back wall member and that is above the base space for receiving the furniture unit, the back wall member having a back wall height dimension that is greater than the unit height dimension so that at least a portion of the back wall member is observable above the furniture unit when the furniture unit is received within the receiving space, wherein the back wall member includes a substantially rectangular and planar member that includes oppositely facing front and rear surfaces where the front surface faces the receiving space;

a substantially flat planar rear base member that traverses the distance between the first and second ends of the base wall and that is substantially perpendicular to the first and second base wall members wherein the base wall is mounted to the rear base member;

wherein the furniture unit is receivable on the top edge surface of the base wall within the receiving space; and wherein the back wall member includes top and bottom edges and first and second lateral edges and wherein the assembly further includes first and second connectors mounted to the rear surface of the back wall member adjacent the first and second lateral edges for connecting the apparatus to a similar apparatus.

18. The apparatus of claim 17 wherein each of the first and second connector members includes an elongated planar rectangular member that extends from the rear surface of the back wall member and substantially along the entire height dimension of the back wall member so that the back wall member and the first and second connector members together form a channel adjacent the rear surface of the back wall member.

19. A free standing furniture apparatus comprising:

a furniture unit having a unit height dimension and including at least one storage compartment;

a base including a base wall having a base height dimension and first and second separated base wall ends, the base wall at least in part circumscribing a base space where the base wall includes a top edge surface that resides substantially in a single edge plane; and a back wall member supported by the base wall proximate the first and second ends of the base wall and extending substantially vertically upward from the base wall and substantially perpendicular to the single edge plane so that there is a receiving space that is unobstructed by the back wall member and that is above the base space for receiving the furniture unit, the back wall member having a back wall height dimension that is greater than the unit height dimension so that at least a portion of the back wall member is observable above the furniture unit when the furniture unit is received within the receiving space;

wherein the furniture unit is receivable on the top edge surface of the base wall within the receiving space;

wherein the furniture unit includes a top member and first and second side wall members that support the top member and that space the top member from the base when the furniture unit is received on the top edge surface of the base wall, each of the first and second side wall members having a bottom edge spaced from the top member and wherein the furniture unit further includes a top and bottom rear stringer members that extend between the first and second side wall members proximate the top member and the bottom edges of the first and second side wall members, respectively.

20. The apparatus of claim 19 further including fasteners that attach each of the top and bottom rear stringers to the back wall member.

21. The apparatus of claim 19 wherein the base wall includes at least first, second and third substantially flat and planar base wall members where the first and second base wall members are parallel and spaced apart and form the first and second ends of the base wall and wherein the third base wall member extends between the ends of the first and second base wall members opposite the first and second ends of the base wall and is substantially perpendicular to each of the first and second base wall members.

22. The apparatus of claim 19 wherein the back wall member includes top and bottom edges and first and second lateral edges and wherein the assembly further includes first and second connectors mounted to the rear surface of the back wall member adjacent the first and second lateral edges for connecting the apparatus to a similar apparatus.

23. The apparatus of claim 22 wherein each of the first and second connector members includes an elongated planar rectangular member that extends from the rear surface of the back wall member and substantially along the entire height dimension of the back wall member so that the back wall member and the first and second connector members together form a channel adjacent the rear surface of the back wall member.

24. The apparatus of claim 19 wherein the base wall includes at least first, second substantially flat and planar base wall members where the first and second base wall members are parallel and spaced apart and form the first and second ends of the base wall and wherein the first and second base wall members form at least a portion of the top edge surface that receives the furniture unit.

* * * * *